US009926127B2

(12) United States Patent
Grinwald et al.

(10) Patent No.: US 9,926,127 B2
(45) Date of Patent: Mar. 27, 2018

(54) METHOD OF USING A CORNER BOARD PROTECTOR

(71) Applicant: All About Packaging Inc., Appleton, WI (US)

(72) Inventors: Brent J. Grinwald, Appleton, WI (US); Craig A. Olson, Appleton, WI (US)

(73) Assignee: All About Packaging, Inc., Appleton, WI (US)

( * ) Notice: Subject to any disclaimer, the term of this patent is extended or adjusted under 35 U.S.C. 154(b) by 0 days.

(21) Appl. No.: 15/612,341

(22) Filed: Jun. 2, 2017

(65) Prior Publication Data

US 2017/0267429 A1 Sep. 21, 2017

Related U.S. Application Data

(60) Continuation-in-part of application No. 15/051,489, filed on Feb. 23, 2016, now Pat. No. 9,694,961, which is a division of application No. 14/267,805, filed on May 1, 2014, now Pat. No. 9,272,832, which is a continuation-in-part of application No. 13/679,589, filed on Nov. 16, 2012, now Pat. No. 9,382,054.

(60) Provisional application No. 61/818,793, filed on May 2, 2013.

(51) Int. Cl.
*B65D 81/05* (2006.01)

(52) U.S. Cl.
CPC ..... *B65D 81/054* (2013.01); *B65D 2581/051* (2013.01); *B65D 2581/053* (2013.01); *B65D 2581/055* (2013.01); *Y10T 29/49826* (2015.01)

(58) Field of Classification Search
CPC ..... B65D 81/054; B65D 2581/055; B65D 2581/053; Y01T 29/49826
USPC ..... 206/586, 386, 597, 497, 593; 108/55.1; 29/428
See application file for complete search history.

(56) References Cited

U.S. PATENT DOCUMENTS

| | | | | |
|---|---|---|---|---|
| 1,200,467 A | | 10/1916 | Cady | |
| 2,328,397 A | | 8/1943 | Neuman | |
| 2,593,998 A | * | 4/1952 | Dupuis | B65D 5/005 206/509 |
| 3,416,652 A | | 12/1968 | Almasy | |
| D220,166 S | | 3/1971 | Griffith | |
| 3,776,145 A | * | 12/1973 | Anderson | B65D 19/36 108/51.3 |
| 3,955,677 A | | 5/1976 | Collingwood | |
| 4,078,673 A | | 3/1978 | Wilhelmi | |
| 4,148,394 A | | 4/1979 | Bederman | |
| 4,201,138 A | * | 5/1980 | Cox | B65D 71/0096 108/55.1 |

(Continued)

*Primary Examiner* — Steven A. Reynolds
(74) *Attorney, Agent, or Firm* — Thomas J. Connelly; Northwind IP Law, S.C.

(57) ABSTRACT

A method of using a corner board protector to protect a corner on a palletized stack of containers. The method includes the steps of forming a one piece, corner board locator having a connection portion and an insert portion, and the corner board locator having an opening formed therethrough. Positioning the insert portion between two vertically aligned containers of the palletized stack of containers. Forming a corner board having two angled panels and a length. Inserting the two angled panels through the opening formed in the corner board locator to retain the corner board at a select height relative to the palletized stack of containers.

20 Claims, 15 Drawing Sheets

(56) References Cited

U.S. PATENT DOCUMENTS

| | | | | | |
|---|---|---|---|---|---|
| 4,265,184 | A | | 5/1981 | Cox | |
| 4,292,901 | A | * | 10/1981 | Cox | B65D 71/0096 108/55.1 |
| 5,115,917 | A | * | 5/1992 | Schrage | B65D 11/22 108/55.1 |
| 5,161,692 | A | * | 11/1992 | Knierim | B65D 5/32 206/320 |
| 5,161,693 | A | | 11/1992 | Friman | |
| 5,251,753 | A | | 10/1993 | Pigott et al. | |
| 5,339,957 | A | | 8/1994 | Carstens | |
| 5,624,031 | A | | 4/1997 | Fowler et al. | |
| 5,772,037 | A | * | 6/1998 | Hurley | B65D 81/054 206/586 |
| 6,012,587 | A | * | 1/2000 | McCullough | B65D 71/0096 206/453 |
| 6,499,626 | B1 | | 12/2002 | Julius | |
| 6,685,021 | B2 | | 2/2004 | Dodson et al. | |
| 6,971,518 | B1 | | 12/2005 | Lowry | |
| D660,454 | S | * | 5/2012 | Lavelle | D24/227 |
| 8,231,004 | B2 | | 7/2012 | Port et al. | |
| D709,360 | S | | 7/2014 | Lavelle | |
| 8,910,790 | B2 | * | 12/2014 | Trickett | B65D 71/0088 206/497 |
| 9,272,932 | B2 | | 3/2016 | Philipp | |
| 9,382,054 | B2 | | 7/2016 | Grinwald et al. | |
| 2005/0269229 | A1 | | 12/2005 | Lowry | |
| 2005/0284783 | A1 | | 12/2005 | May, Jr. | |
| 2009/0029130 | A1 | | 1/2009 | Stubing | |
| 2009/0032432 | A1 | | 2/2009 | Kostos et al. | |
| 2011/0180450 | A1 | | 7/2011 | Hainer | |
| 2011/0293398 | A1 | | 12/2011 | Leibreich et al. | |
| 2013/0032506 | A1 | | 2/2013 | Grenchus, Jr. et al. | |
| 2014/0238893 | A1 | | 8/2014 | Grinwald et al. | |

* cited by examiner

METHOD OF USING A CORNER BOARD PROTECTOR

CROSS-REFERENCE TO RELATED PATENT APPLICATIONS

The present application is a Continuation-in-Part application and claims priority to U.S. Ser. No. 15/051,489, filed Feb. 23, 2016 and entitled: A METHOD OF USING A CORNER BOARD PROTECTOR, which claims priority as a Divisional application under 35 U.S.C. § 120 to U.S. Ser. No. 14/267,805, filed May 1, 2014 and entitled: PALLET CORNERBOARD LOCATOR, now issued as U.S. Pat. No. 9,272,832, which (1) claims priority under 35 U.S.C. § 119 e) to Provisional U.S. Ser. No. 61/818,793 filed on May 2, 2013 and entitled: PALLET CORNERBOARD LOCATOR, and (2) claims priority as a Continuation-in-Part under 35 U.S.C. § 120 U.S. Ser. No. 13/679,589 filed on Nov. 16, 2012 and entitled: PALLET CORNERBOARD LOCATOR, now issued as U.S. Pat. No. 9,382,054, the full disclosure of which is hereby incorporated by reference.

FIELD OF THE INVENTION

This invention relates to a method of using a corner board protector to protect a corner on a palletized stack of containers.

BACKGROUND OF THE INVENTION

Corner boards are sometimes used to protect the corners of containers stacked upon a pallet. Locating and retaining the corner boards in place with respect to the stack of containers prior to stretch wrapping the palletized stack of containers or strapping of the stack of containers to the pallet may be difficult.

Now a method of protecting one or more corners on a palletized stack of containers has been invented which is easy to accomplish using inexpensive components.

SUMMARY OF THE INVENTION

Briefly, this invention relates to a method of using a corner board protector to protect a corner of a palletized stack of containers includes the steps of forming a one piece, corner board locator having a connection portion and an insert portion. The corner board locator also has an opening formed therethrough. The insert portion is positioned between two vertically aligned consecutive containers of the palletized stack of containers. A corner board is formed which has two angled panels and a length. The two angled panels are inserted through the opening formed in the corner board locator to retain the corner board at a select height relative to the palletized stack of containers.

An alternative method of using a corner board protector to protect a corner of a palletized stack of containers includes the steps of forming a one piece, corner board locator having a connection portion and an insert portion. The insert portion also has a single continuous planar exterior edge. The corner board locator also has an opening formed therethrough. The single continuous planar exterior edge of the insert portion is positioned between two vertically aligned consecutive containers of the palletized stack of containers. A corner board is formed which has two angled panels and a length. The two angled panels are inserted through the opening formed in the corner board locator to retain the corner board at a select height relative to the palletized stack of containers. The method further includes positioning stretch wrap material around the palletized stack of containers.

A third method of using a corner board protector to protect a corner of a palletized stack of containers includes the steps of forming a one piece, corner board locator having a connection portion and an insert portion. The corner board locator also has an opening formed therethrough. A corner board id formed having two angled panels and a length. The two angled panels of the corner board are inserted through the opening formed in the corner board locator. Both the corner board locator and the corner board are positioned adjacent to a corner of the palletized stack of containers. The insert portion of the corner board locator is then inserted between two vertically aligned, consecutive containers of the palletized stack of containers to retain the corner board at a select height relative to the palletized stack of containers.

The general object of this invention is to provide a method of using a corner board protector to protect a corner of a palletized stack of containers. A more specific object of this invention is to provide a method of protecting all four corners of a palletized stack of containers.

Another object of this invention is to provide a method of using a corner board protector to protect a corner of a palletized stack of containers which is simply and easy to perform.

Still another object of this invention is to provide a method of using a corner board protector to protect a corner of a palletized stack of containers which uses inexpensive components.

A further object of this invention is to provide a method of using a corner board protector to protect a corner of a palletized stack of containers which can be performed by a single person.

Still further, an object of this invention is to provide a method of using a corner board protector to protect a corner of a palletized stack of containers which is economical to use.

Other objects and advantages of the present invention will become more apparent to those skilled in the art in view of the following description and the accompanying drawings.

DETAILED DESCRIPTION OF THE INVENTION

Figure 1:
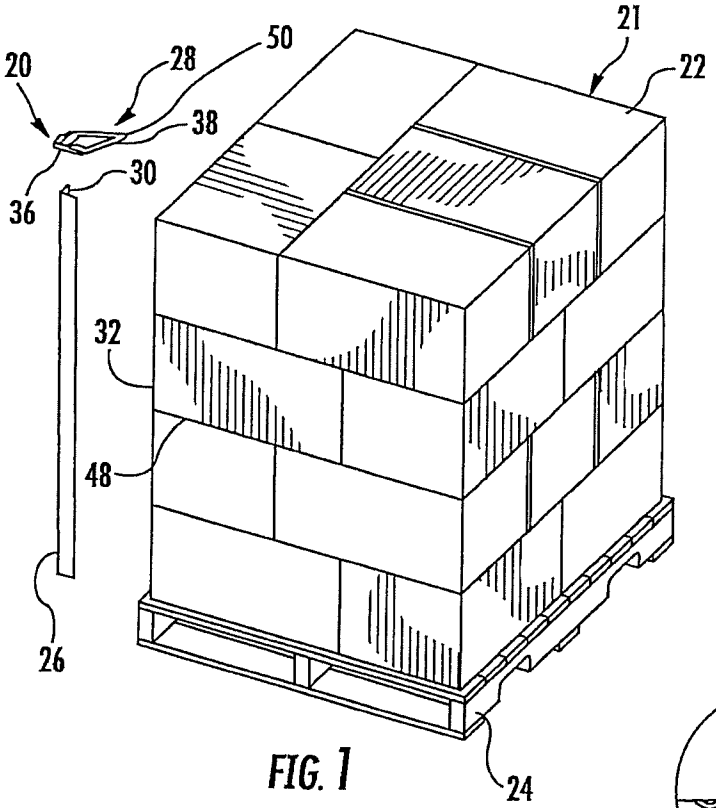
FIG. 1 is a perspective view of an example corner protection system for use with a palletized stack of containers.

FIG. 1 illustrates a corner protection system or corner protector 20 for use with a palletized stack 21 of containers 22 resting upon a pallet 24. The palletized stack 21 can include a plurality of vertically stacked containers 22. The corner protector 20 protects the corners of the stack 21 during shipment, storage and display. As will be described hereafter, the corner protector 20 is reliably and securely located and retained with respect to the stack 21 and the containers 22 prior to stretch wrapping or strapping of the containers 22 on a pallet 24.

The corner protector 20 includes a corner board 26 and one or more corner board locators 28, 28. The corner board 26 includes an elongate angled member or structure forming an angled cavity 30 configured to receive a corner 32 of the stack 21 of the containers 22. In the example illustrated, the corner board 26 has a length sufficient to extend along an entirety of the corner 32 of the stack 21. In other implementations, the corner board 26 may have a length less than the entire height of the corner 32 of the stack 21, wherein a portion of the corners 32 of the containers 22 may not be protected or wherein the corner board 26 may be combined with other corner boards 26 to collectively protect the corners 32, 32. In one implementation, the corner board 26 is formed from cardboard. In another implementation, the corner board 26 may be formed from other materials: such as styrofoam, an open cell polymer, a closed cell polymer, wood, ceramics, or various other materials known to those skilled in the art.

The corner board locator 28 includes a member or structure configured to be connected or mounted to the corner board 26 so as to project from the corner board 26. The corner board locator 28 includes a connection portion 36 and an insert portion 38. The connection portion 36 includes that portion of the corner board locator 28 configured to mount the corner board locator 28 to the corner board 26. Alternatively, the corner board 26 can be secured to the corner board locator 28. In the example illustrated, the connection portion 36 includes an opening 44, depicted as an angled slot (shown in FIG. 3) extending on and along an end portion of the insert portion 38. The opening 44 is formed through the corner board locator 28. The opening 44 can vary in configuration and could be shaped as an angle, a right angle, a triangle, a square, a rectangle, etc. In the example illustrated, the opening 44 is depicted as an angled slot. The angled slot can be a substantially right angled slot to accommodate the corner board 26 which may be formed from two substantially right angled panels. In other implementations, the opening 44 can be two slots formed at some other angle to accommodate a corner board 26 having two panels arranged at some other angles. The opening 44 can create a friction grip or interference fit with the corner board 26. The opening 44 slidably receives a cross-section of the corner board 28 to facilitate adjustable or selectable positioning of the corner board locator 28 along the length of the corner board 26. As a result, the corner protector 20, formed from the combination of the corner board 26 and the corner board locator 28, may accommodate differently located seams, interfaces or cracks 48 which may vary depending upon different heights or different dimensions of different containers 22 or combination of containers 22.

It should be understood that the connection portion 36, of the corner board locator 28, may have other configurations. For example, the connection portion 36 may include a tab, a hook, a tongue, a flap, etc. The connection portion can be insertable into one of a series of spaced open or closed pockets, straps, tab receiving slits, loops, buttonholes or the like formed along the length of the corner board 26. In another implementation, the connection portion 36 may include a tab, a flap or a tongue having an adhesive, which has sufficient tackiness, to secure and retain the corner board locator 28 to the corner board 26 at a selected position along the corner board 26.

The insert portion 38 of the corner board locator 28 includes a flap, wing, finger, tongue, projection or panel extending from the connection portion 36. The insert portion 38 extends outward or away from the connection portion 36. The insert portion 38 is designed to be inserted between two vertically aligned containers 22. When the corner board locator 28 and the corner board 26 are attached or secured together, the insert portion 38 extends or projects away from the corner board 26. The insert portion 38 can extend in a direction substantially perpendicular or normal to each of the panels or walls of the corner board 26. The insert portion 38 has a thickness so as to project from the corner board 26 and to be insertable into contact with an underside of a container 22 positioned on a pallet 24, without substantially elevating or tipping the overlying container 22. In one implementation, the insert portion 38 has a maximum thickness which is less than or equal to about 0.25 inch (about 6.35 millimeters). Desirably, the thickness of the insert portion 38 is less than about 0.25 inches (about 6.35 millimeters). In one implementation, the insert portion 38 may be inserted into a seam or crack 48 situated between two vertically consecutive packages or containers 22 stacked on a pallet 24. In another implementation, the insert portion 38 may be inserted below a lower most container 22 of the stack 21 of containers 22, between the lower most container 22 and the pallet 24. In some implementations, the insert portion 38 may be located along the corner board 26 so as to project on top of, and partially across a topmost package or container 22 of the stack 21 of containers 22 on the pallet 24. Additionally, the insert portion 38 may be fastened to the pallet 24 before the lower most container 22 is placed on the pallet 24. The insert portion 38 may be fastened to the pallet 24 by any means, including adhesive, tape, nail, screw, staple, rivet, or by some other fastener known to those skilled in the art. In the example illustrated, the insert portion 38 has a pointed tip 50 to facilitate insertion below an overlying container 22. In other implementations, the insert portion 38 may have a rounded tip 50, or may have some other shape. In some implementations, the tip 50 may be tapered, similar to that of the blade, to facilitate insertion into a seam or crack 48 or insertion between a lowermost container 22 and the pallet 24.

Figure 2:
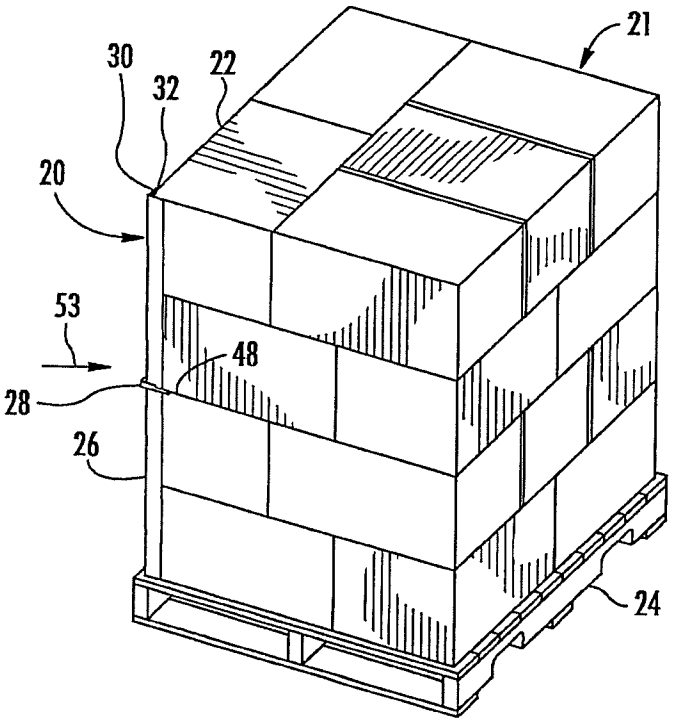
FIG. 2 is a perspective view of the corner protection system of FIG. 1 positioned on the palletized stack of containers.
Figure 3:
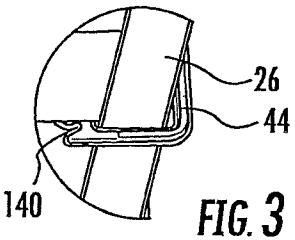
FIG. 3 is an enlarged fragmentary perspective view of the corner protection system of FIG. 2.

FIGS. 2 and 3 illustrate an exemplary use of the corner protector 20. As shown in FIG. 3, the corner board locator 28 is positioned and secured along the corner board 26 at a selected height such that the insert portion 38 will align opposite to a seam or crack 48. In the example, the corner board 26 is slid through the opening 44 of the corner board locator 28 until it is position that a desired location. As noted above, in other implementations, the corner board locator 28 may be selectively positioned along the corner board 26 in some other fashion. Alternatively, one or more of the corner board locators 28, 28 can be inserted between two vertically align containers 22 in a spaced apart fashion, and then the corner board 26 can be attached or secured to the opening 44 formed in each of the corner board locators 28.

As shown in FIGS. 2 and 3, once the corner board locator 28 has been a properly position along the corner board 26, the corner protector 20 is moved in a substantially horizontal direction (as indicated by arrow 53) towards the stack 21 until the cavity 30 receives the corner 32 with the insert portion 38 received within the seam or crack 48. The insert portion 38 retains the corner board 26 in place relative to the corner 32 prior to the stack 21 being wrapped by stretch film or being secured with strapping. The insert portion 38 further retains the corner board 26 in place after the stretch wrapping, stretch film, or strapping has been removed. The weight of the overlying containers 22 (also known as packages, cartons, boxes, bins, sub pallets, modules and the like) bearing down upon the insert portion 38 of each corner board locator 28, 28 provides a friction hold inhibiting accidental or inadvertent withdrawal of the insert portion 38. This retention is provided with minimal scratching or damaging of the containers 22.

Although the corner protector 20 has been described as including a single corner board locator 28 selectively positioned along the corner board 26, in other implementations, the corner protector 20 may include two or more corner board locators 28, 28 along the length of the corner board 26. For example, the corner protector 20 may include a first corner board locator 28 situated between the pallet 24 and a lowermost container 22 of the stack 21, and a second corner board locator 28 can be located below the uppermost container 22 of the stack 21. Alternatively or additionally, one or more corner board locators 28, 28 can be inserted into different seams or cracks 48 along the vertical height of the stack 21.

The corner protector 20 has been illustrated and described as having one or more corner board locators 28, 28 being separable from the corner board 26. This allows for use of the corner board locators 28, 28 with different corner boards 26, having different lengths, for stacks 21 of containers 22 with different heights. The corner board locators 28, 28 can be reused a number of times. If damaged, the corner board locators 28, 28 can be discarded. In other implementations, the corner protector 20 can slide up or down along the stack 21, or the corner protector 20 may be captured between stops, catches, caps or blocking structures located at one or both ends of the corner board 26. Although the corner protector 28 has been illustrated as having one or more corner board locators 28, 28 that move along the corner board 26, in other implementations, the corner board locators 28, 28 may be fixed in place relative to the corner board 26. For example, the corner board locators 28, 28 may be integrally formed as part of a single unitary body with the corner board 28. In this case, each corner board locator 28 can be attached or secured to the corner board 26. One could bond, fasten, weld, or otherwise fixedly connect to the corner board 26 to each of the corner board locators 28, 28. In this embodiment, the connection portion 36 could be omitted such that the insert portion 38 provides a panel projecting from the corner board 26 and extends outward so as to contact the underside of a container 22 in a stack 21 of containers 22.

Figure 4:
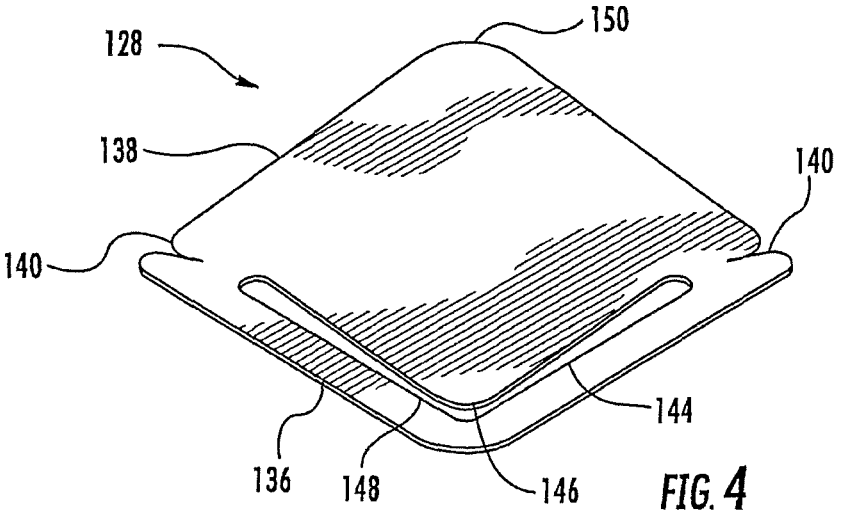
FIG. 4 is a perspective view of an example corner board locator of the corner protection system of FIG. 1.
Figure 5:
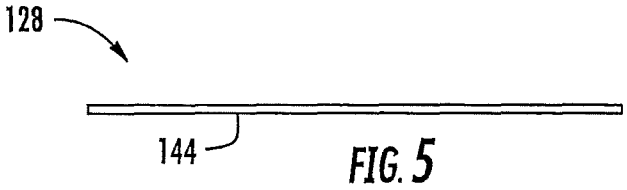
FIG. 5 is a sectional view of the locator of FIG. 4.
Figure 6:
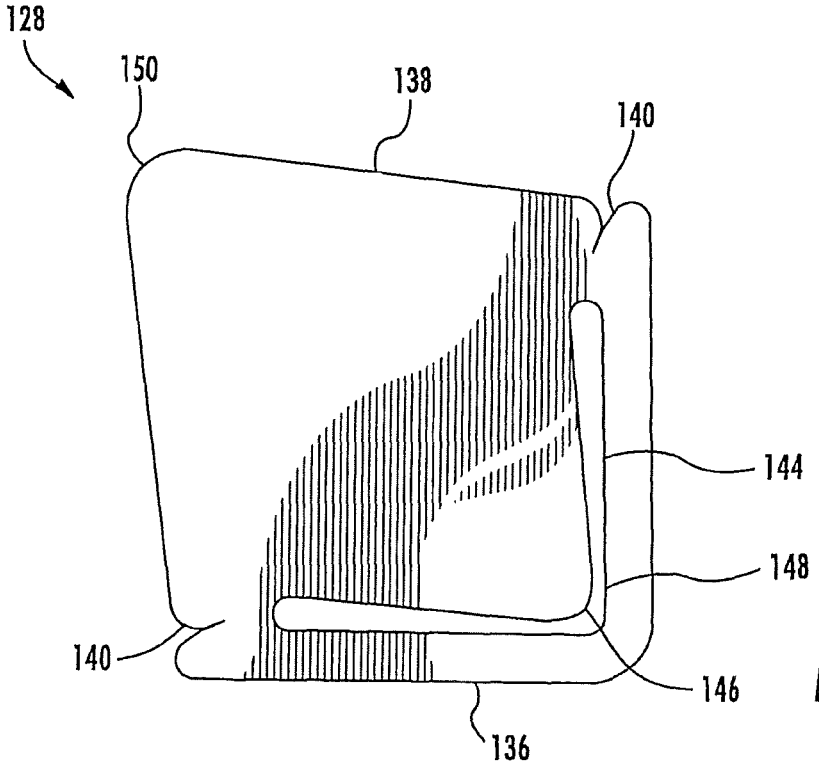
FIG. 6 is a top view of the locator of FIG. 4.

FIGS. 4-6 illustrate another embodiment of a corner board locator 128. The corner board locator 128 includes a connection portion 136, an insert portion 138, and hooks 140. The connection portion 136 facilitates connecting the corner board locator 128 to the corner board 26 (shown in FIG. 1). The connection portion 136 includes an opening 144 configured as an angled slot. The angled slot is similar to opening 44 shown in FIG. 3. In the example illustrated, the opening or angled slot 144 has a tapering width extending towards a point 146 to create a pinch point 148. The angle between the sides of the opening or angled slot 144 could be greater than, equal to, or less than the angle between the panels or walls of the corner board 26. During insertion of the corner board 26 through the opening or angled slot 144, the point 146 resiliently flexes to enlarge the pinch point 148. This action allows sliding movement of the corner board 26 through the opening or angled slot 144. Also, the panels or walls of the corner board 26 might flex relative to one another to accommodate the acute or obtuse angle of the sides of the opening or angled slot 144. The corner board locator 128 is moved to a desired position at which the point 146 of the corner board locator 128 grips the interiors of the cavity 30, at or near the concave interior corner of the corner board 26. This action retains the corner board locator 128 in a selected position along the corner board 26. Additionally, the sides of the opening or angled slot 144 aid in gripping the exteriors of the cavity 30, away from the corner of the corner board 26, to retain the corner board locator 128 in a selected position along the corner board 26. As noted above, the opening or angled slot 144 may have other angles or other dimensions depending upon the angles and dimensions of the corner board 26. The insert portion 138 is similar to the insert portion 38 referred to in FIGS. 1-3, in that the insert portion 138 is configured to be inserted beneath and in contact with an underside of a container 22 of the stack 21 (see FIG. 1). As with the insert portion 38, the insert portion 138 includes a point 150, to facilitate such insertion.

Still referring to FIGS. 4-6, the corner board locator 128 can also include a pair of hooks 140, 140. Each of the pair of hooks 140, 140 can be shaped or configured to be a catch, a slit, a knob, or be of some other structure. The pair of hooks 140, 140 is located along the insert portion 138, on two opposite ends of the opening or angled slot 144. The pair of hooks 140, 140 is configured to receive and grip stretch wrap material and can facilitate the start of the stretch wrapping of the stack 21 of the containers 22. As shown in FIG. 3, each hook 140 is located such that upon insertion of the insert portion 138 into a seam or crack 48 (or between a container 22 and the pallet 24), each hook 140 project outward beyond the sides of the stack 21 for reception of the stretch wrap. In other implementations, the pair of hooks 140, 140 may be omitted.

In FIGS. 4-6, the corner board locator 128 is formed from a single panel or sheet of material with all of the structures extending in a single plane. The corner board locator 128 may be formed from material such as paper board, die cut plastic, injection molded plastic, metal, wood or bamboo. In other implementations, the corner board locator 128 may be formed from multiple pieces which are fastened, bonded, welded or otherwise joined to one another.

Figure 7:
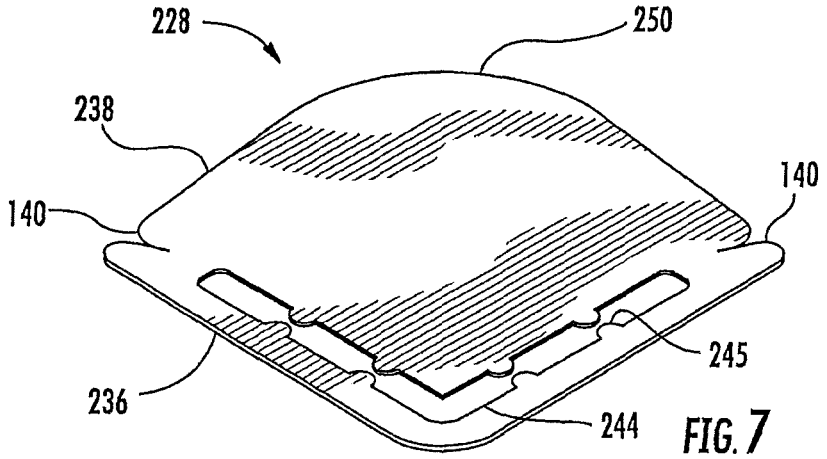
FIG. 7 is a perspective view of an example corner board locator of the corner protection system of FIG. 1.
Figure 8:
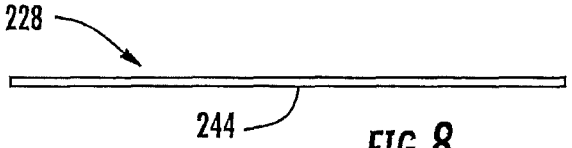
FIG. 8 is a sectional view of the locator of FIG. 7.
Figure 9:
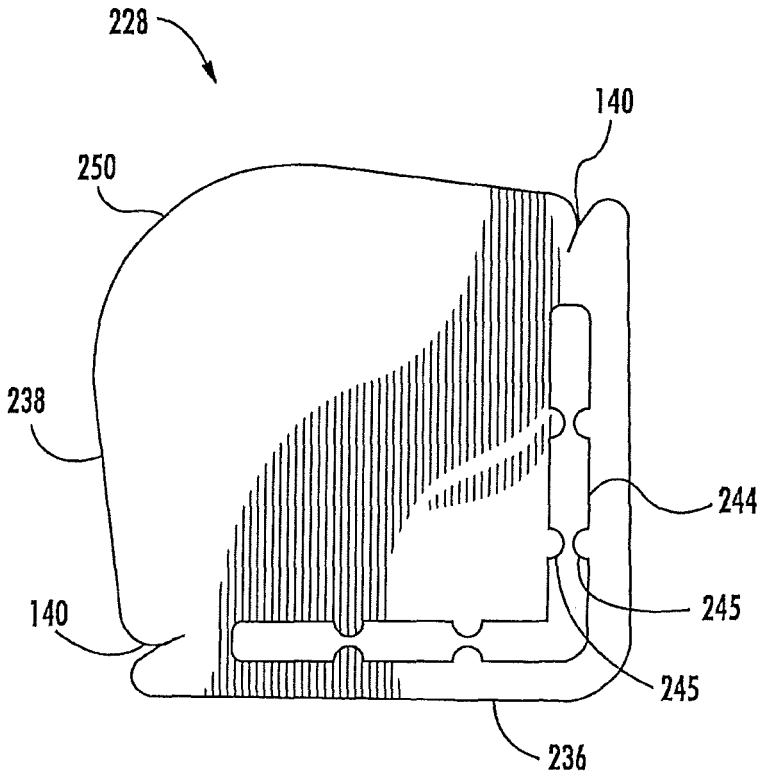
FIG. 9 is a top view of the locator of FIG. 7.

Referring now to FIGS. 7-9, another embodiment of a corner board locator 228 is shown. In this embodiment, the corner board locator 228 is used in a similar fashion as the corner board locators 28 and 128. The corner board locator 228 includes a connector portion 236, an insert portion 238 and a pair of hooks 140, 140. The connection portion 236 is similar to the connection portion 136 except that the connection portion 236 includes an opening 244 in the shape of a slot and teeth 245 in place of the opening or angled slot 144. Like the openings 44 and slot 144, the opening 244 is configured to slidably receive a cross-section of the corner board 26.

The teeth 245 include a projection that extend or project into the opening or slot 244. Although such teeth 245 are illustrated as having a rounded end or tips, in other implementations, the teeth 245 can be jagged, rectangular or pointed. The teeth 245 are configured to resiliently flex during insertion and sliding movement of the corner board 26 through the opening or slot 244. Once the corner board 26 is in position at a desired location, the teeth 24 resiliently return towards their default or original position to grip or bite into the corner board 26. This action will resist accidental or inadvertent sliding movement of the corner board locator 238 with respect to the corner board 26. In one implementation, those portions of the corner board locator 228 from which the teeth 245 project may also be configured to resiliently flex during insertion or movement of the corner board 26. In other implementations, such portions of the corner board locator 228, located adjacent to the teeth 245, may have a greater overall stiffness as compared to the teeth 245.

The insert portion 238 is similar to the insert portion 38 and 138, except that the insert portion 238 has a rounded tip 250. The rounded tip 250 provides additional stiffness (as compared to a more pointed tip 50) to facilitate insertion of the corner board locator 228 into a seam 48 or crack, or between a lower most container 22 and a pallet 24. The corner board locator 228 may be formed from material such as paper board, die cut plastic, injection molded plastic, metal, wood or bamboo. In other implementations, the corner board locator 228 may be formed from multiple pieces which are fastened, bonded, welded otherwise joined to one another.

Figure 10:
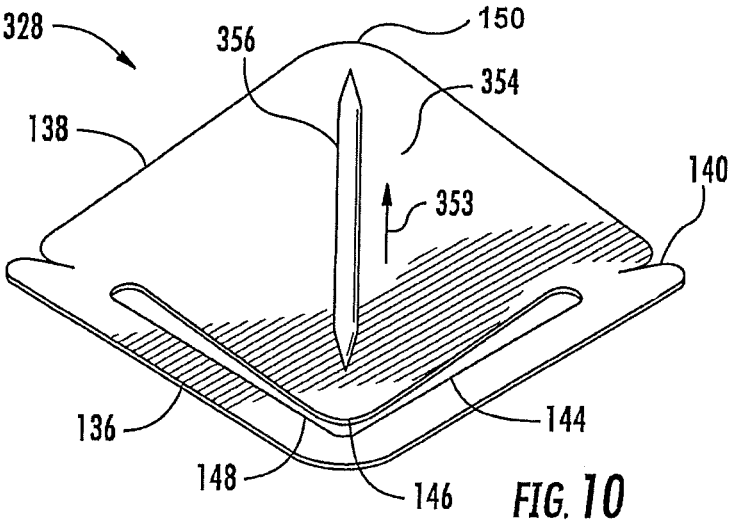
FIG. 10 is a perspective view of an example corner board locator of the corner protection system of FIG. 1.
Figure 11:
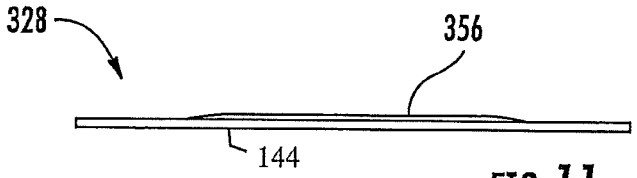
FIG. 11 is a side view of the locator of FIG. 10.
Figure 12:
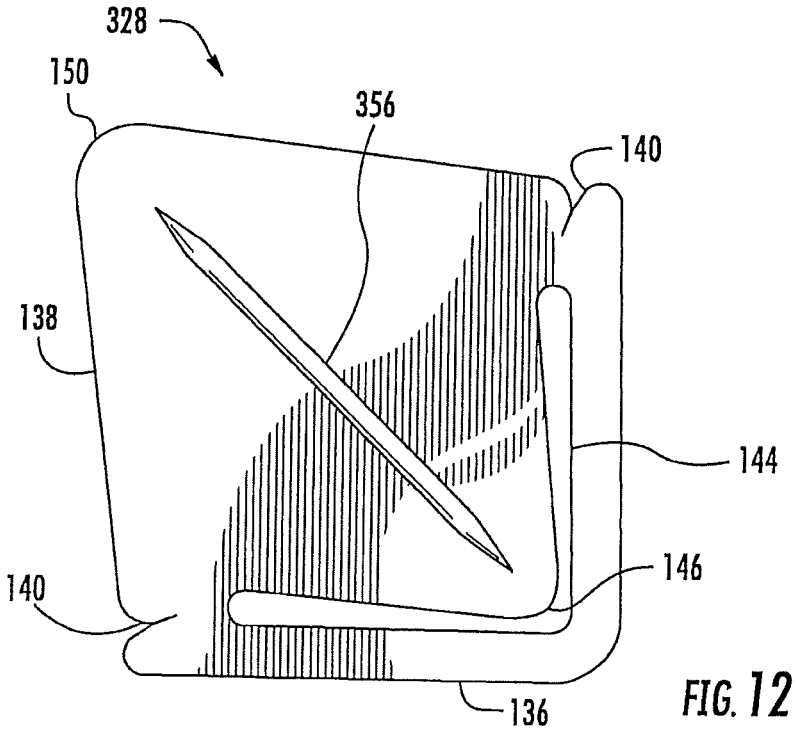
FIG. 12 is a top view of the locator of FIG. 10.

Referring now to FIGS. 10-12, another embodiment of a corner board locator 328 is shown. The corner board locator 328 is similar to the corner board locator 128, except that the corner board locator 338 includes an antiskid face 354. The antiskid face 354 includes surface characteristics which offers enhanced resistance to relative horizontal movement between the insert portion 138 of the corner board locator 328 and the overlying (or underlying) container 22 in contact with the antiskid face 354. In the example illustrated, the antiskid face 354 includes one or more lines 356 of fugitive glue which have a greater coefficient of friction with respect to the underlying or overlying container 22, as compared to those surfaces of the insert portion 138 adjacent to the lines 356.

In other implementations, the antiskid face 354 may have other configurations to resist accidental or inadvertent movement of the insert portion 138 relative to an underlying or overlying container 22 in the stack 21 (see FIG. 1). For example, the one or more lines 356 may be formed from other materials such as polymers or cellulose materials. Although a single line 356 is illustrated, in other implementations, multiple lines 356 (either aligned, intersecting, staggered or jagged) (similar to treads) may be provided. Additionally, stylistic patterns of the lines 356, of any complexity, may be printed, molded, or otherwise adhered to the antiskid face 354. The line 356 is illustrated as extending parallel to an insertion direction 353 for the corner board locator 338. The line 356 extends from a point 146 towards a second point 150. In other implementations, the one or more lines 356, 356 may alternatively extend perpendicular to the insert direction 353 or may extend at some other angle relative to the insert direction 353. In other implementations, the antiskid face 354 may include a roughened surface with grits (similar to sandpaper) to provide a greater coefficient of friction with respect to an adjacent container 22. Although the corner board locator 328 is illustrated as having one antiskid face 354, in other implementations, both the upper surface and a lower surface of the insert portion 138 may be provided with the antiskid face 354. For example, the one or more lines 356, 356 may be provided on both the upper surface and the lower surface of the insert portion 138 for frictional engagement with the containers 22, both above and below the insert portion 138.

Figure 13:
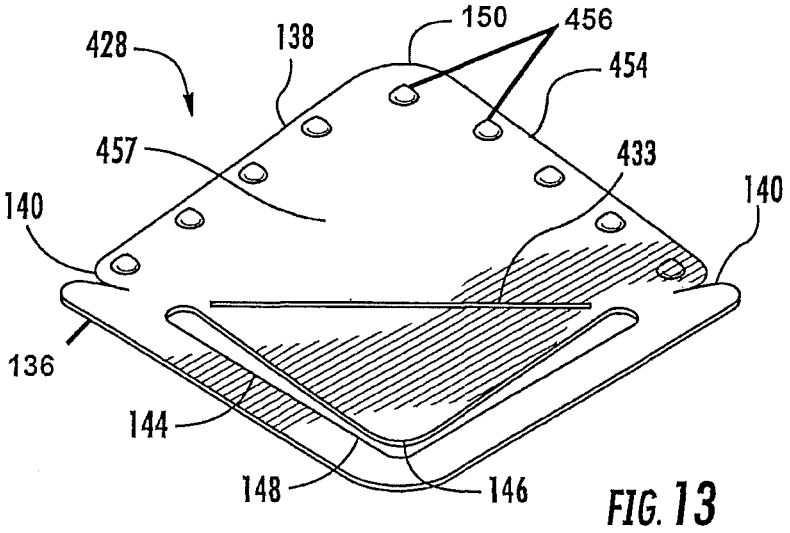
FIG. 13 is a perspective view of an example corner board locator of the corner protection system of FIG. 1.
Figure 14:
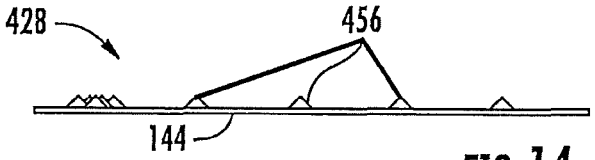
FIG. 14 is a sectional view of the locator of FIG. 13.
Figure 15:
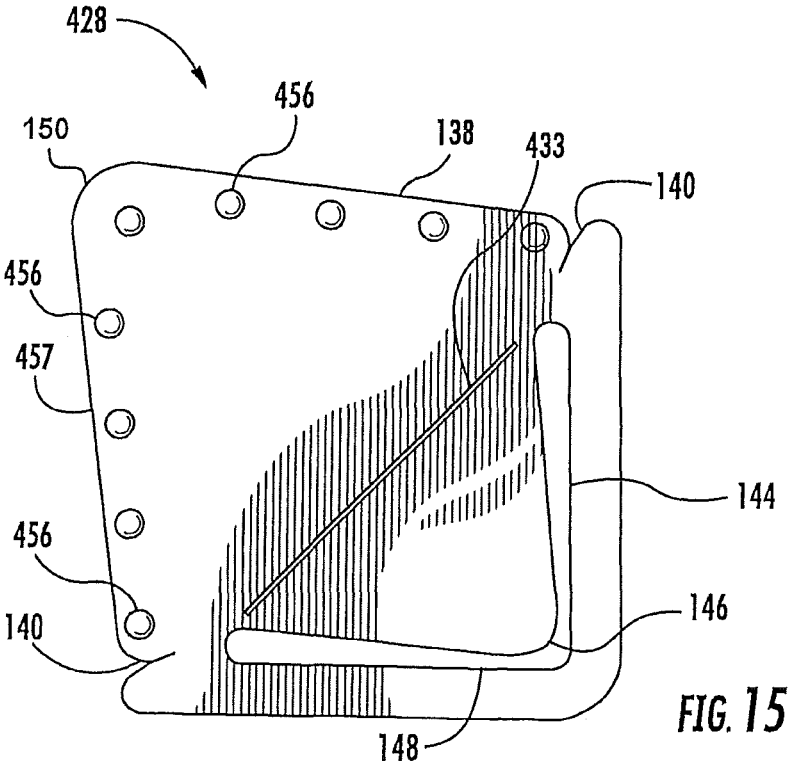
FIG. 15 is a top view of the locator of FIG. 13.

Referring now to FIGS. 13-15, another embodiment of a corner board locator 428 is shown. The corner board locator 428 is used in a similar fashion as is the corner board locator 28. The corner board locator 428 is similar to the corner board locator 128 except that the corner board locator 428 additionally includes a hinge 433 and an antiskid face 454. The remaining components of the corner board locator 428 correspond to the components of the corner board locator 128 and are numbered similarly.

The hinge 433 includes a structure which facilitates pivoting the point 146. In one example, the hinge 433 includes a crease, serration, groove or score forming a weakened region or line between the point 146 and a central portion 457 of the insert portion 138. This weakened region facilitates pivoting of the point 146 during sliding of the corner board 26 through the opening or slot 144. In one implementation, portions of the corner board locator 428, approximate the point 146, may be rigid. In other implementations, portions of the corner board locator 428 may be resiliently flexible so as to bend (in addition to the bending or pivoting about the hinge 433) in response to the corner board 26 sliding through the opening or slot 144. In other implementations, the hinge 433 may include a living hinge that is molded rather than being formed by material removal processes such as die cutting or scoring.

The antiskid face 454 includes a surface characteristic which offers enhanced resistance to relative horizontal movement between the insert portion 138 of the corner board locator 428 and the overlying (or underlying) container 22 in contact with the antiskid face 454. In the example illustrated, the antiskid face 454 includes a series of spaced proturberances or projections 456. Such proturberances or projections 456 increase a level of resistance against sliding movement of the insert portion 138 relative to an underlying and/or overlying container 22. In the example illustrated, the proturberances or projections 456 may be formed by embossing or debossing the panel forming insert portion 138 so as to project up and/or down. For example, in one implementation, embossments and debossments may be formed on opposite surfaces of the insert portion 138 to form proturberances or projections 456 projecting in opposite directions to provide the corner board locator 428 with an antiskid face 454 on both opposite surfaces of the insert portion 138. In other implementations, the proturberances or projections 456 may be molded as part of the corner board locator 428 or be bonded, welded or otherwise adhered to the insert portion 138.

Figure 16:
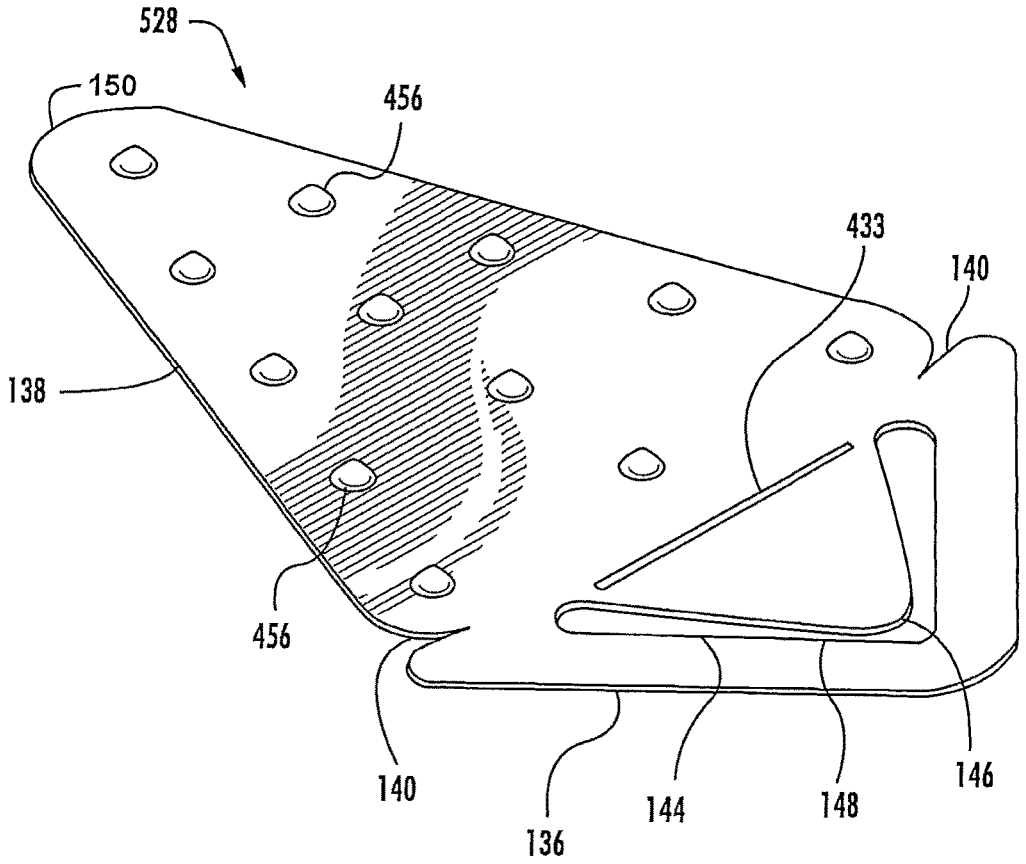
FIG. 16 is a perspective view of another example of the locator of FIG. 13.

In the example illustrated, the proturberances or projections 456 are arranged in lines or rows along the insert portion 138 of the central portion 457. In other implementations, the proturberances or projections 456 may have other arrangements on the surface of the central portion 457. For example, the proturberances or projections 456 may be arranged in other rows or may be arranged randomly across the surface of the insert portion 138. For example, with reference to FIG. 16, an alternative corner board locator 528 is illustrated. Although illustrated as circular dimples or pointed cones, the proturberances or projections 456 may have other shapes and/or sizes. Although illustrated as extending on a single surface of the insert portion 138, the proturberances or projections 456 may alternatively extend upon both opposite surfaces of the insert portion 138.

Figure 19:
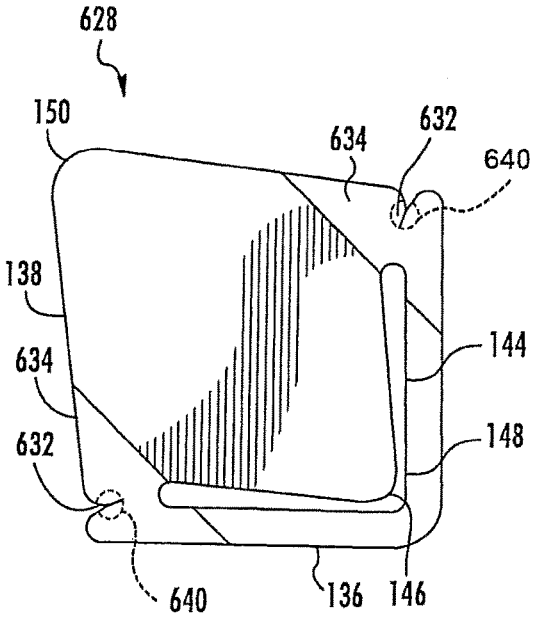
FIG. 19 is a top view of the locator of FIG. 13.
Figure 20:
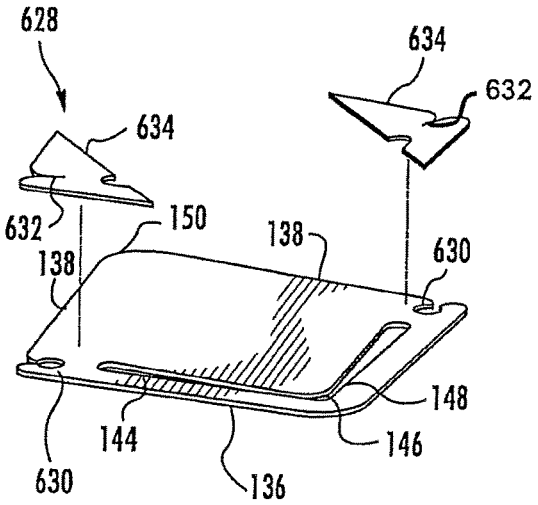
FIG. 20 is an exploded perspective view of the locator of FIG. 17.

Referring now to FIGS. 17-20, another embodiment of a corner board locator 628 is shown. The corner board locator 628 is configured to be used in a fashion similar to the corner board locator 28. The corner board locator 628 is similar to the corner board locator 128 except that the corner board locator 628 includes a pair of hooks 640, 640 in lieu of the pair of hooks 140, 140. Each of the pair of hooks 640, 640 is formed as a multi-piece construction. As shown in FIG. 20, each of the pair of hooks 640, 640 includes a base opening, cut out, indentation or notch 630 and a slit 632 formed in a supplemental layer 634. The notch 630 includes an opening extending into the single panel or sheet to form the insert portion 138. Although the notch 630 is illustrated as being circular, in other implementations, the notch 630 may have other shapes.

The slit 632 overlies or extends opposite to the notch 630 so as to form a narrow mouth through which stretch wrap material may be inserted into the notch 630. The slit 632 is formed as part of the resiliency supplement layer 634. In the example illustrated, the resiliency supplement layer 634 is formed from a material and/or has a thickness or configuration so as to have a greater resiliency as compared to the insert portion 138 and those portions of the insert portion 138 extending about the notch 630. The greater resiliency facilitates improved retention and capturing of stretch wrap. In one implementation, the supplemental layer 634 is formed from one or more polymers or plastics. In another implementation, the single panel or sheet forming the insert portion 138 includes a thick paperboard which is inexpensive, sturdy and easy to recycle. At the same time, the supplemental layer 634, formed from one or more polymers, offers greater resiliency for enhanced stretch wrap capture. In another implementation, the supplemental layers 634 are bonded, glued, fastened or otherwise adhered to the main panel forming the insert portion 138.

Figure 17:
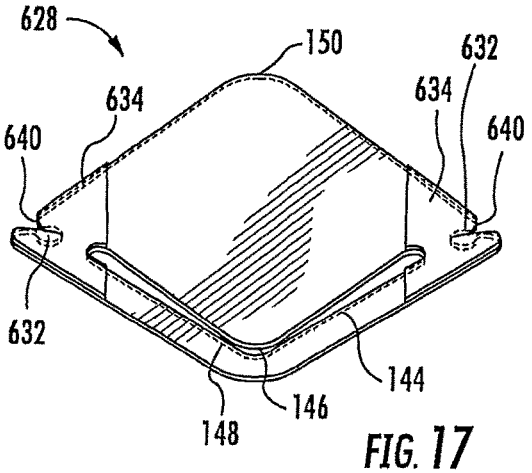
FIG. 17 is a perspective view of an example corner board locator of the corner protection system of FIG. 1.
Figure 18:
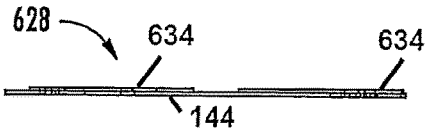
FIG. 18 is a sectional view of the locator of FIG. 13.

Although the supplemental layers 634 are illustrated as being laminated or otherwise bonded to the insert portion 138, adjacent to the notches 630, on a single surface of the insert portion 138, in other implementations, additional supplemental layers 634 may be laminated to the main panel of the insert portion 138 on an opposite surface of the insert portion 138 such that the notch 630 is sandwiched between two opposing supplemental layers 634. Also, FIGS. 17 and 19 show the supplemental layers 634, 634 to be two separate bodies, but in other implementations the supplemental panel 634 could be manufactured as a single body that contains two or more slits 632, 632 which extend around or adjacent to the opening or slot 144.

Figure 22:
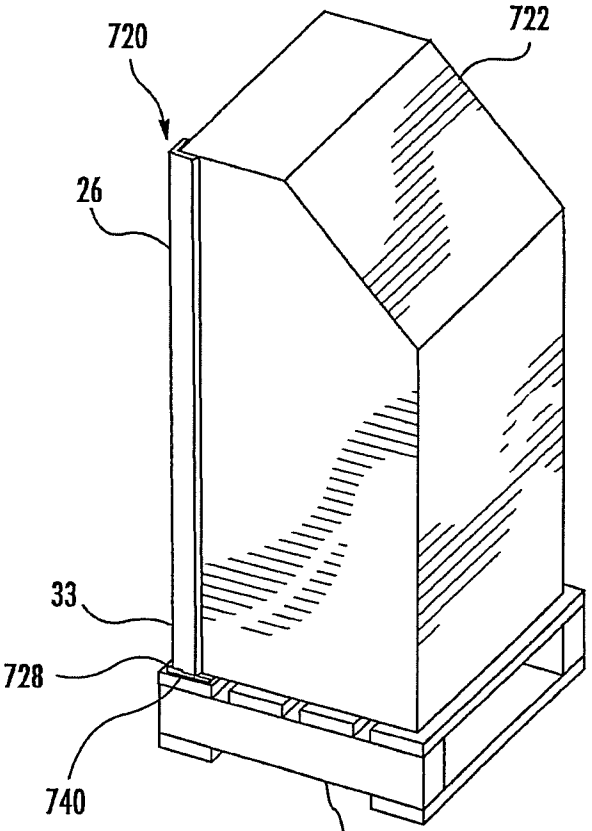
FIG. 22 is a perspective view of the corner protection system of FIG. 21 positioned on the example container.
Figure 21:
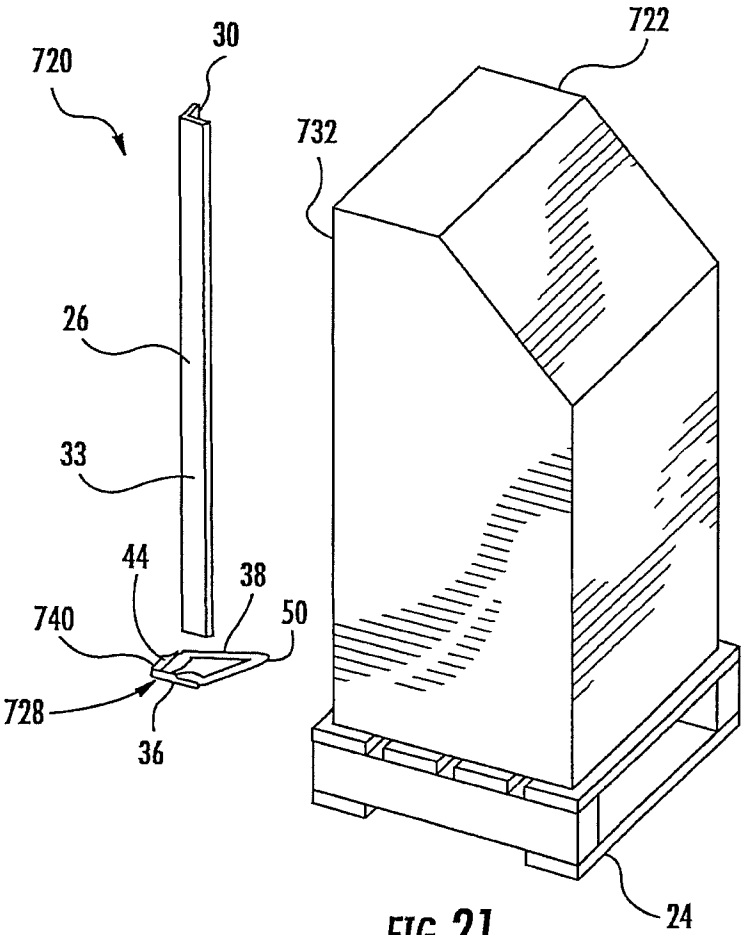
FIG. 21 is a perspective view of an example corner protection system for use with a container.
Figure 23:
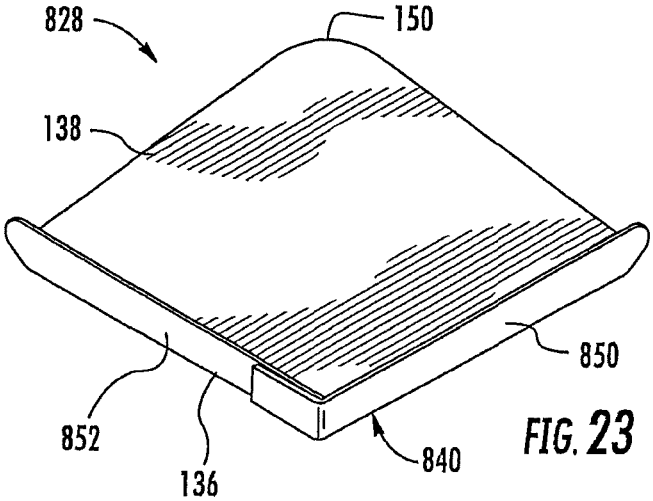
FIG. 23 is a perspective view of an example corner board locator of the corner protection system of FIG. 21.
Figure 24:
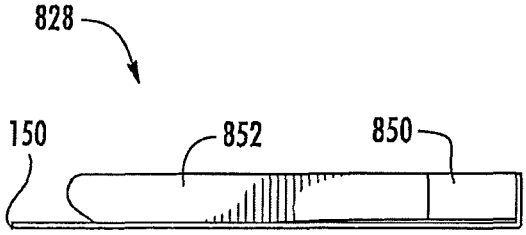
FIG. 24 is a front view of the locator of FIG. 23.
Figure 25:
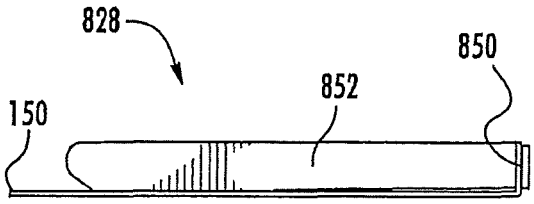
FIG. 25 is a left view of the locator of FIG. 23.
Figure 26:
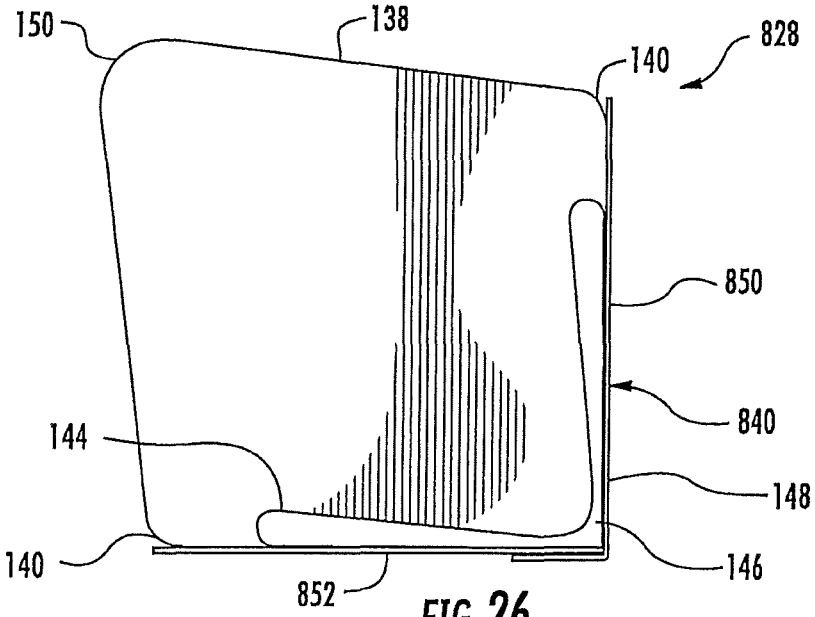
FIG. 26 is a top view of the locator of FIG. 23.
Figure 27:
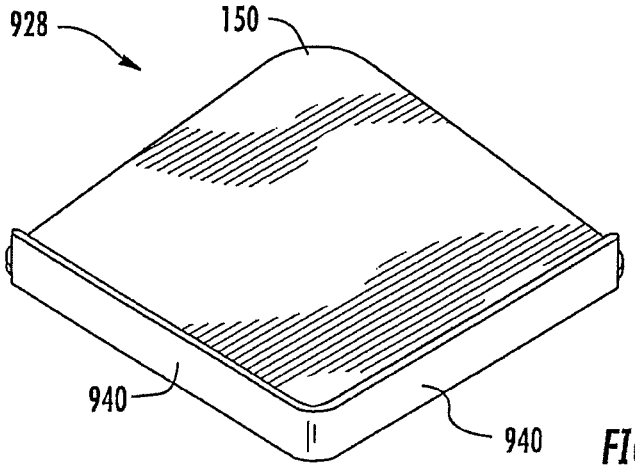
FIG. 27 is a perspective view of an example corner board locator of the corner protection system of FIG. 21.
Figure 28:
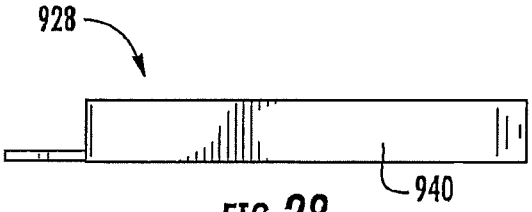
FIG. 28 is a front view of the locator of FIG. 27.
Figure 29:
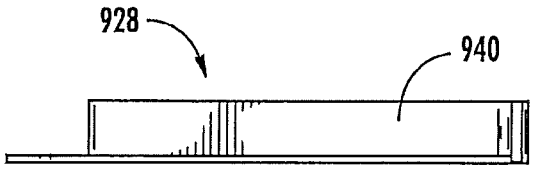
FIG. 29 is a rear view of the locator of FIG. 27.
Figure 30:
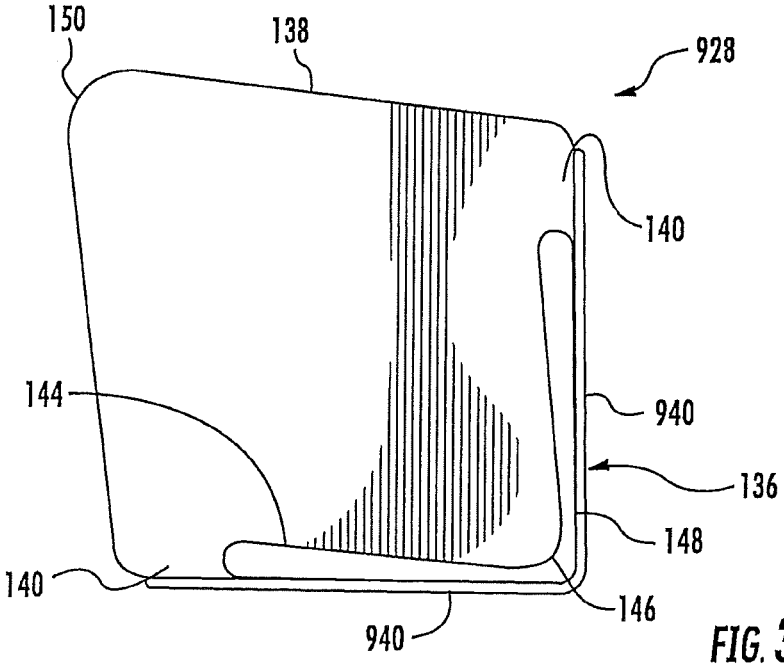
FIG. 30 is a top view of the locator of FIG. 27.
Figure 31:
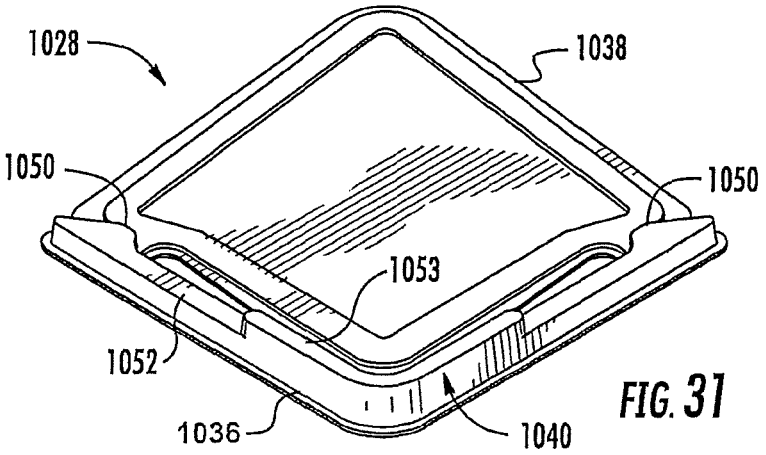
FIG. 31 is a perspective view of an example corner board locator of the corner protection system of FIG. 21.
Figure 32:
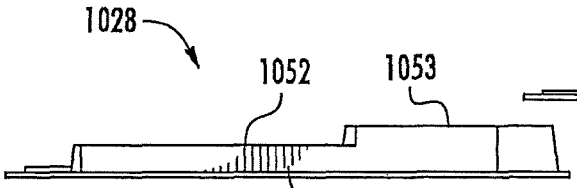
FIG. 32 is a front view of the locator of FIG. 31.
Figure 33:
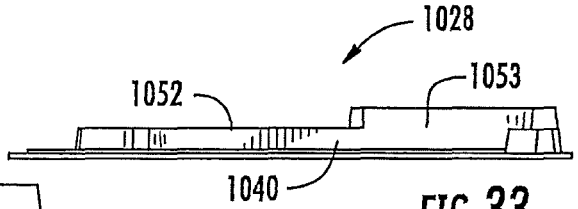
FIG. 33 is a rear view of the locator of FIG. 31.
Figure 34:
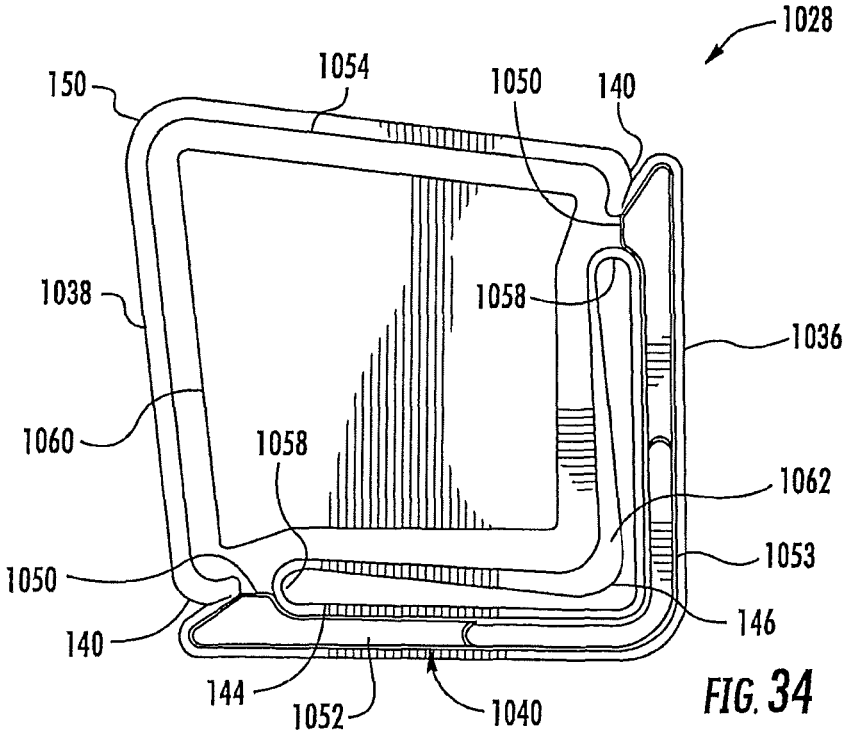
FIG. 34 is a top view of the locator of FIG. 31.
Figure 35:
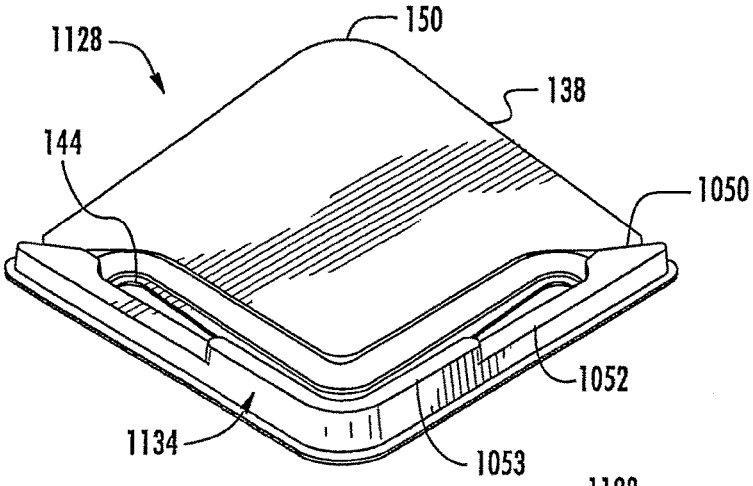
FIG. 35 is a perspective view of an example corner board locator of the corner protection system of FIG. 21.
Figure 37:
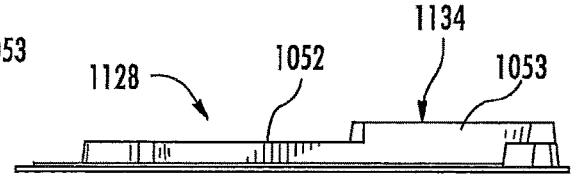
FIG. 37 is a rear view of the locator of FIG. 35.
Figure 36:
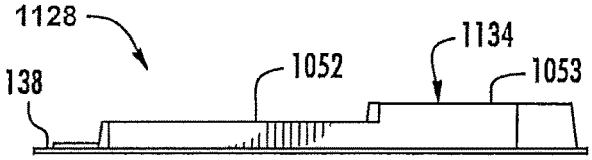
FIG. 36 is a front view of the locator of FIG. 35.
Figure 38:
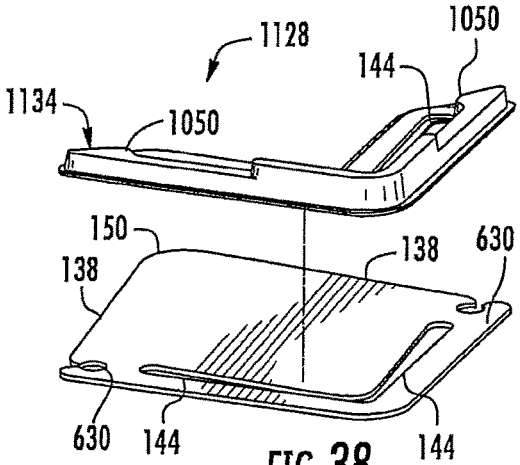
FIG. 38 is an exploded perspective view of the locator of FIG. 35.
Figure 39:
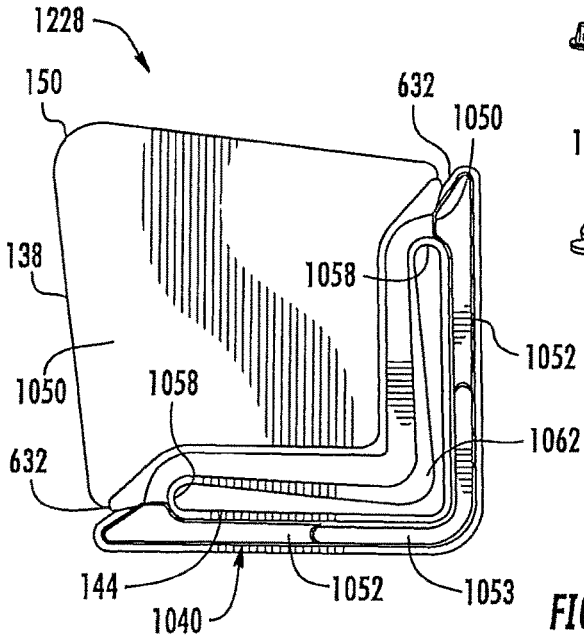
FIG. 39 is a top view of the locator of FIG. 35.

Referring now to FIGS. 21 and 22, another embodiment of a corner protection system or corner protector 720 is shown for use with a container 722 resting upon a pallet 24. The container 722 may include a single package, article, product, furniture, retail display, assembly and the like. The container 722 may also include a wrapped palletized stack of multiple containers (such as shown in FIGS. 1 and 2). Many familiar with the practice of placing corner boards at the corners of a palletized load know that, in some situations, the corner boards contribute substantially to the stacking strength or stability of a palletized load. Some may also find it difficult, because of a load's size or shape or some other factor, to ensure that the corner boards stay in place during transit, even after the corner boards have been bound to the load and/or pallet 24 with stretch wrap or banding. Often tape, adhesives, or other fasteners cannot be used to hold a corner board to a load because such methods would cause unacceptable damage to or leave unacceptable marks on the surface of a load. In some cases, significant stacking strength or stability is lost because the bottom of a single corner board is displaced from its original location on the top surface of a pallet 24. The corner protector 720 protects the corners of such items resting upon a pallet 24 and for which it is desirable to protect the corners thereof. The corner protector 720 protects the corners of the container 722 during shipment, storage and display. As will be described hereafter, the corner board locator 728 reliably and securely locates and retains the bottom of the corner board 26 with respect to the container 722 after stretch wrapping or strapping of the container 722 onto the pallet 24. As compared to the corner protector 20 including and utilizing any of the variations of the corner board locator 28 described above, the corner protector 720 better facilitates retention of the bottom of the corner board 26 in the absence of seams or cracks 48. The corner protector 720 may more reliably support the corner board 26 while being positioned at a bottom of the container 722 between the container 722 and the pallet 24.

The corner protector 720 includes a corner board 26 (described above) and a corner board locator 728. The corner board locator 728 is similar to the corner board locator 28 (as well as the other variations of corner board locator 28 described above) except that the corner board locator 728 additionally includes a raised or upstanding wall 740. Those remaining components of the corner board locator 728, which correspond to the components of the corner board locator 28, are numbered similarly. As with the corner board locator 28 (or any of the other variations of the corner board locator 28 described above), the corner board locator 728 may be formed from a variety of materials such as paperboard, non-paperboard cellulose-based material, die cut plastic, injection molded plastic (polymers), thermoformed plastic, metal, wood and bamboo.

The wall 740 includes at least one wall portion positioned adjacent to and along the edges of the opening or slot 44. Desirably, the wall 740 is positioned along an outer side of the opening or 44 and on an opposite side of opening or slot 44 with respect to the tip 50 located on the insert portion 38. In the example illustrated, the wall 740 continuously extends along the opening or slot 44. In other implementations, the wall 740 includes multiple spaced wall portions or tabs spaced along the opening or slot 44. In one implementation, the wall 740 has a height above the opening or slot 44, at the corner of the opening or slot 44, of at least about 0.1 inch (about 2.54 millimeters (mm)). Desirably, the wall 740 extends from between about 0.1 inch to about 1.50 inches (about 2.54 mm to about 38.1 mm) above the opening or slot 44. More desirably, the wall 740 extends from about 0.75 inches to about 1.25 inches (about 19.05 mm to about 31.75 mm) above the opening or slot 44 to assist in supporting the corner board 26. In other implementations, the wall 740 may have other heights. In some implementations, the internal surfaces of the wall 740 may include prongs or spikes which further engage the outer surfaces of the corner board 26 to assist in retaining the corner board 26.

FIG. 22 illustrates use of a corner protector 720 to protect a corner 732 of a container 722. In use, the corner board locator 728 surrounds the bottom of the corner board 26, at the bottom of the container 722, above the pallet 24. In particular, the opening or slot 44 receives a lower edge of the cross-section of the corner board 26 while the insert portion 38 extends below and is in contact with an underside of the container 722, between the container 722 and the pallet 24. At the same time, the wall 740 projects upwardly from the opening or slot 44 along the outer right angle faces 33 of the corner board 26 to inhibit inadvertent displacement of the corner board 26 away from the corner 732, and in some cases, to assist in propping the corner board 26 up in a vertical orientation. In the example illustrated, the opening or slot 44 extends completely through the corner board locator 728. In this example, the corner board locator 728 can be slid upward and downward along the corner board 26 for those circumstances where the corner board locator 728 is to be used with a stack of containers (such as shown in FIGS. 1 and 2) wherein the insert portion 38 of the corner board locator 728 is inserted into a seam or crack 48 between adjacent containers 22, 22. In another implementation, the opening or slot 44 does not extend through the corner board locator 728 but instead supports the bottom of the corner board 26. In this configuration, the corner board locator 728 is limited to only being placed between the bottom of the container 722 and the pallet 24.

Referring now to FIGS. 23-26, a corner board locator 828 is shown which is similar to the corner board locator 128 except that the corner board locator 828 additionally includes a wall 840. Those remaining elements or components of the corner board locator 828 which correspond to the components of the corner board locator 128 are numbered similarly. The wall 840 extends upwardly along a front edge of the opening or slot 144. In the example illustrated, the wall 840 is formed as a single unitary body (a homogeneous structure) with the insert portion 138. In this example, the wall 840 is formed by upwardly bending tabs or flap portions 850, 852 of the single panel forming the corner board locator 828, adjacent to the opening or slot 144, and securing the flap portions 850, 852 to one another by bonding, welding, fastening, interlocking or some other known method, to form a substantially right angle wall 840. In one implementation, the corner board locator 828 is formed from a single part or piece which is die cut from a flat sheet of material (paperboard, die cut plastic, injection molded plastic, metal and the like), wherein scoring utilized to assist in the formation of the flaps 850, 852. In other implementations, the wall 840 may formed in other fashions.

Referring now to FIGS. 27-30, a corner board locator 928 is shown which is similar to the corner board locator 828, except that the corner board locator 928 includes upstanding walls 940, 940 in place of the wall 840. The walls 940, 940 are identical to the wall 840 but the walls 940, 940 are injection molded as part of the insert portion 138. As a result, the corner board locator 928 may be more easily fabricated and the walls 940, 940 may be more strongly supported.

Referring now to FIGS. 31-34, a corner board locator 1028 is shown. The corner board locator 1028 includes a connection portion 1036 and an insert portion 1038. The connection portion 1036 is similar to connection portion 136 of the corner board locator 928 except that the connection portion 1036 includes a wall 1040 in lieu of the wall 940. The wall 1040 includes retention portions 1050, 1050, a lower plateau 1052 and an upper plateau 1053. In other implementations, a single plateau or upper surface caps the wall 1040. The retention portions 1050, 1050 include portions of the wall 1040 which at least partially wrap about the ends 1058, 1058 of the opening or slot 144. The retention portions 1050, 1050 assist in securing and aligning the corner board 26. The retention portions 1050, 1050 further serve to add additional stiffening strength to the wall 1040.

The lower plateau 1052 extends from the retention portions 1050 to the upper plateau 1053. The lower plateau 1052 provides a first level of stiffness and support along the corner board 26. The upper plateau 1053 extends between portions of the lower plateau 1052 and rises above the lower plateau 1052 opposite a point 150, at a point 146 located at the corner of the opening or slot 144. The upper plateau 1053 provides a greater degree of stiffness and support for the corner board 26 at the corner of the corner board 26. In some implementations, the lower and upper plateaus, 1052 and 1053 respectively, may be omitted.

The insert portion 1038 is similar to the insert portion 138 except that the it includes an additional geometry 1060 and a flexible tab 1062. The geometries 1060 include channels, walls, embossments, debossments, and the like. The geometry 1060 provides additional stiffening to the insert portion 1038 and will also provide the insert portion 1038 with an antiskid face 1054. The additional stiffening provided by the geometry 1060 provides the corner board locator 1028 with sufficient strength. The geometry 1060 allows the corner board locator 1028 to be formed from a sheet of thermoplastic material or molded pulp paperboard. In other implementations, the corner board locator 1028 may be formed from other materials known to those skilled in the art, and may be formed in other fashions.

The flexible tab 1062 includes an inner edge of the opening or slot 144. The flexible tab 1062 has an enhanced degree of flexibility and resiliency as compared to adjacent portions of the connection portion 1038. The flexible tab 1062 resiliently flexes or bends during sliding movement of the corner board 26 through the opening or slot 144 and is resiliently urged against the inserted corner board 26 to grip or pinch against the inserted corner board 26 to assist in retaining the inserted corner board 26 in a desired location along the corner board 26. In this example, the flexible tab 1062 continuously extends along the inner edge of the opening or slot 144, between the opening or slot 144 and the point 150. In other implementations, the flexible tab 1062 may include a plurality of spaced flexible tabs which are spaced along the inner edge of the opening or slot 144. In other implementations, the flexible tab 1062 may be omitted.

Referring now to FIGS. 35-39, a corner board locator 1128 is shown. The corner board locator 1128 is similar to the corner board locator 628 except that the corner board locator 1128 includes a supplemental mount 1134 in lieu of the supplemental layers 634, 634. The supplemental mount 1134 is mounted to the separate main panel forming the opening or slot 144, the notches 630 and the insert portion 138. The supplemental mount 1134 is similar to the wall 1040 of the corner board locator 1028 except that the supplemental mount 1134 additionally includes a pair of slits 632, 632. The remaining components of the mount 1134 which correspond to the components of the corner board locator 1028 or 628 are numbered similarly. Each of the pair of slits 632, 632 extends opposite to the notch 630 so as to form a narrow mouth through which a stretch wrap material (not shown) may be inserted into the notch 630. The pair of slits 632, 632 is formed as part of the supplemental mount 1134. In this example, the supplemental mount 1134 is formed from a material and/or has a thickness or configuration so as to have a greater resiliency as compared to the insert portion 138, and those portions of the insert portion 138 extending about the notch 630. The greater resiliency facilitates improved retention and capturing of the stretch wrap material. In one implementation, the supplemental mount 1134 is formed from one or more polymers or plastics. In another implementation, the supplemental mount 1134 can be formed from a single panel or sheet which is used to form the insert portion 138. Alternatively, the supplemental mount 1134 can be a thick paperboard which is inexpensive, sturdy and easy to recycle. The supplemental mount 1134 can be molded or otherwise formed from one or more polymers. The supplemental mount 1134 offers strength to the wall 1040, and further offers enhanced resiliency for the pair of slits 632, 632, thereby enhancing capture of the stretch wrap material. In another implementation, the supplemental mount 1134 is bonded, glued, mechanically fastened or otherwise adhered to the main panel forming the insert portion 138.

Although the supplement mount 1134 is illustrated as being laminated or otherwise bonded to the insert portion 138, adjacent to the notches 630, on a single surface of the insert portion 138, it can be attached in other ways as well. For example, additional supplemental layers 634, described above with respect to the corner board locator 628, may be laminated to the main panel of the insert portion 138, on an opposite surface of the insert portion 138, such that the notch 630 is sandwiched between the opposing supplemental layer 634 and the mount 1134.

Figure 41:
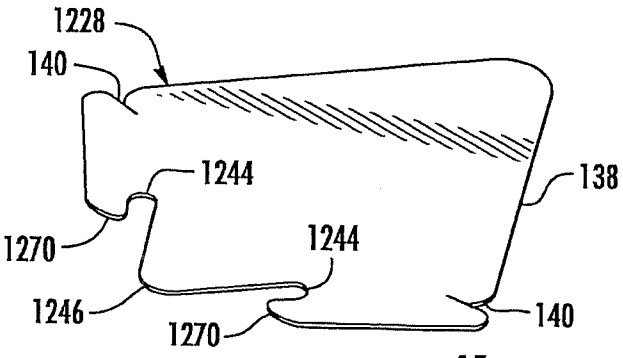
FIG. 41 is a perspective view of a locator of the corner protector of FIG. 40.
Figure 42:
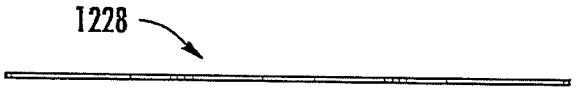
FIG. 42 is a side view of the locator FIG. 41.
Figure 40:
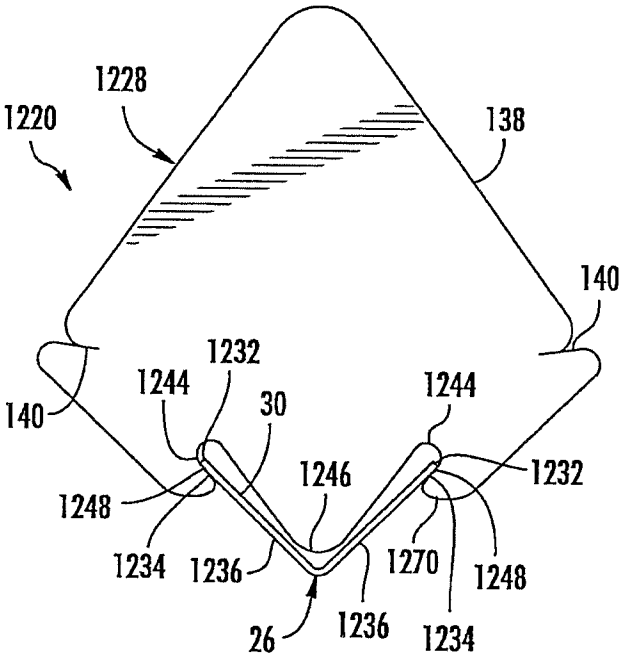
FIG. 40 is a top plan view of another example corner protector.

Referring now to FIGS. 40-42, another embodiment of a corner board locator 1228 is shown. The corner board locator 1228 is joined to the corner board 26 to form a corner protector 1220. In another example, the corner board locator 1228 can be independent of the corner board 26. The corner board locator 1228 includes an insert portion 138 and a pair of hooks 140, 140. The pair of hooks 140, 140 is identical to those described earlier with respect to the corner board locator 128, shown in FIGS. 4-6. Unlike the corner board locator 128, the corner board locator 1228 includes a connection portion 1236. The connection portion 1236 is similar to the connection portion 136 except that the connection portion 1236 includes a pair of notches 1244, 1244 in lieu of the opening or slot 144.

Each of the pair of notches 1244, 1244 includes a recess, a cut out for a detent which extends into the edge of the insert portion 138 of the corner board locator 1228. Each of the pair of notches 1244, 1244 is sized, located and oriented to concurrently receive the two opposite longitudinal (and vertical when employed) longitudinal edges 1232, 1232 and the two end portions 1234, 1234 of the legs 1236, 1236 of the corner board 26. In this example, each of the pair of notches 1244, 1244 extends on opposite sides of a point 1246. The point 1246 contacts a backside of the corner board 26, while the front side of each of the end portions 1234, 1234 contacts the inwardly facing edges 1248, 1248 of the pair of notches 1244, 1244. The point 1246 indicates complete insertion of the corner board 26 into the pair of notches 1244, 1244. Because the point 1246 contacts or closely abuts the backside of the corner board 26 while the edges 1248, 1248 contact or closely abut the front side of the corner board 26, the corner board 26 is held in place with reduced movement while at the same time, allowing the pair of notches 1244, 1244 to have mouths that are substantially wider than the thickness of the corner board 26. This arrangement facilitates insertion of the corner board 26 into the corner board locator 1228. In other implementations, the point 1246 may be omitted or may be shortened so as not to contact the backside of the corner board 26. In other implementations, the pair of notches 1244, 1244 may alternatively contact both sides or faces of the corner board 26 when the corner board 26 is inserted within the pair of notches 1244, 1244.

Figure 45:
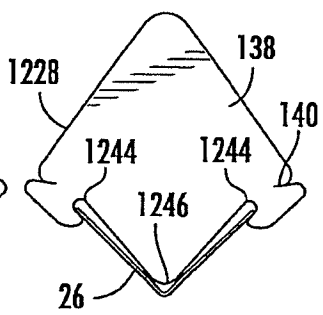
FIGS. 43-45 are top plan views of the locator of FIG. 40 in different sizes.
Figure 44:
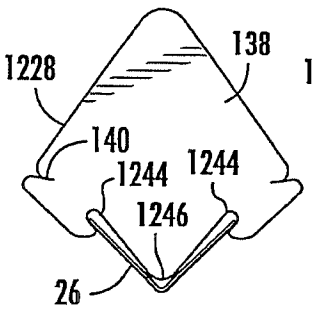
Figure 43:
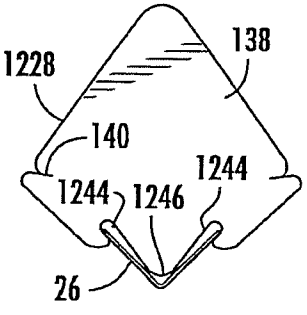

Referring now to FIGS. 43-45, the size of the corner board locator 1228 and the configuration of the pair of notches 1244, 1244 and the point 1246 may be varied to accommodate differently sized corner boards 26.

Figure 46:
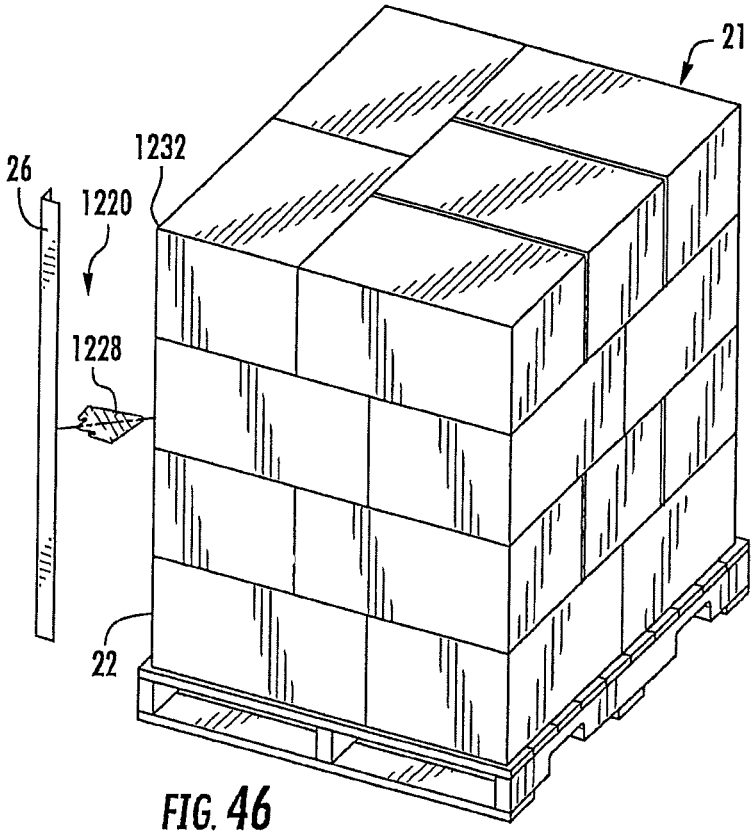
FIG. 46 is a perspective view of a stack in the corner protector of FIG. 40 prior to assembly.
Figure 47:
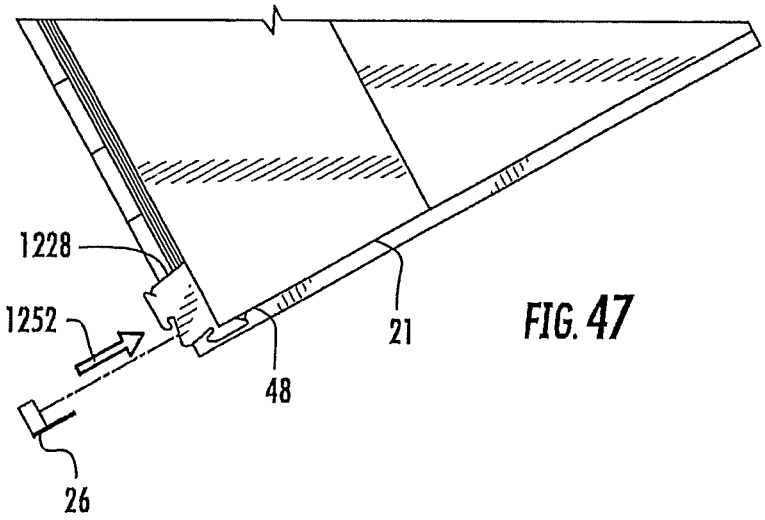
FIG. 47 is a top plan view of the stack of FIG. 46 during insertion of the locator.
Figure 48:
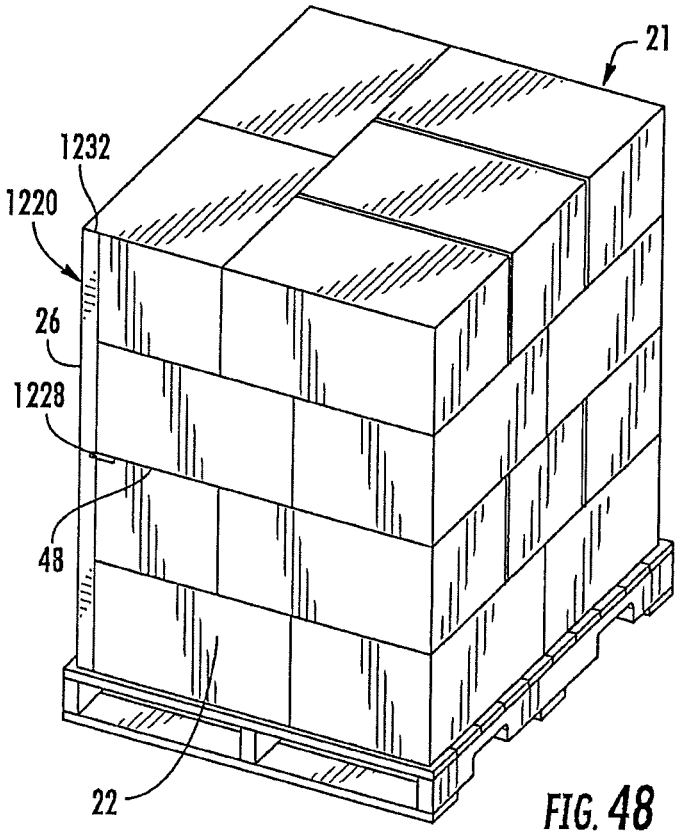
FIG. 48 is a perspective view of the assembled corner protector positioned on the stack.
Figure 49:
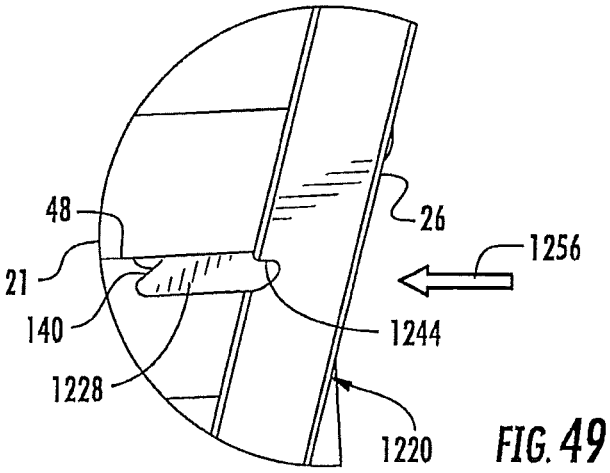
FIG. 49 is an enlarged view of the assembled corner protector and stack of FIG. 48.

Referring now to FIGS. 46-49 the corner board locator 1228 is shown in use. The pair of notches 1244, 1244 facilitate an easy connection of the corner board 26 to the corner board locator 1228. As shown by FIGS. 46 and 47, the corner board locator 1228 is positioned and secured along the corner board 26 at a selected height such that the insert portion 1238 will align opposite to a seam or crack 48 of the stack 21. FIG. 47 illustrates insertion and movement of the corner board locator 1228 in the direction indicated by an arrow 1252 into the seam or crack 48. As shown by FIG. 49, such insertion continues until substantially all of insert portion 1238 is inserted into the seam or crack 48. The hook 140 and the notch 1244 extend or project outward beyond the sides of the stack 21, outwardly beyond the seam or crack 48.

As shown by FIGS. 48 and 49, once the corner board locator 1228 has been properly position within the seam or crack 48, independent of the corner board 26, the corner board 26 is moved in a substantially horizontal direction, as indicated by the arrow 1256, towards the stack 21 until the pair of notches 1244, 1244 receive the edges 1232, 1232. Because the pair of notches 1244, 1244 allow the corner board 26 to be horizontally moved into connection with the corner board locator 1228, rather than being slid through an opening or slot 44, the corner board locator 1228 may be more easily inserted into the seam or crack 48, between tiers of the pallet load, independent of the corner board 26. As a result, the corner board locator 1228 may be more easily position within the seam or crack 48 by shipping personnel or robots.

The insert portion 138 retains the corner board 26 in place relative to the corner 32 prior to the stack 21 being wrapped with stretch film or being secured with strapping. The insert portion 138 further retains the corner board 26 in place after the stretch wrapping or strapping has been removed. The weight of the overlying containers 22, also known as packages, cartons, boxes, bins, sub pallets, modules and the like, bearing down upon the insert portion 138 provide a friction hold which inhibits the accidental or inadvertent withdrawal of the insert portion 138. This retention is provided with minimal scratching or damaging of the containers 22.

Although the corner protector 1220 has been described as including a single corner board locator 1228 selectively positioned along the corner board 26, in other implementations, the corner protector 20 may include a plurality of the corner board locators 1228 along the length of the corner board 26. For example, the corner protector 1220 may include a first corner board locator 1228 located between the pallet 24 and a lowermost container 22 of the stack 21, a second corner board locator 28 located above the uppermost container 22 of the stack 21, and one or more additional corner board locators 1228 inserted into different seams or cracks 48 of the stack 21.

In the above example, the corner board locator 1228 can be formed from a single panel or sheet of material with all of the structures extending in a single plane. In this example, the corner board locator 1228 may be formed from a material, such as: paper board, die cut plastic, injection molded plastic, metal, wood or bamboo. In other implementations, the corner board locator 1228 may be formed from multiple pieces which are fastened, bonded, welded or otherwise joined to one another.

Although the corner board locator 1228 is illustrated as including an insert portion 138 as shown and described above with respect to FIGS. 4-6, in other implementations, the corner board locator 1228 may include one or more of the additional features described above with respect to the corner board locators 228, 328, 428, 528, 628, 728, 828, 928, 1028 and 1128. For example, the pair of notches 1244, 1244 may additionally include teeth 245 as shown with the corner board locator 228. In another implementation, the insert portion 138 may include an antiskid face 354 and/or line 356, as was described for the corner board locator 328. In another implementation, the corner board locator 1228 may additionally or alternatively include projections 456 and/or a hinge 433 as was described for the corner board locator 428. In one implementation, the corner board locator 1228 may additionally or alternatively include supplemental layers 634 as was described for the corner board locator 628, wherein such supplemental layers 634 not only strengthen or form hooks 140, but also strengthen and rigidify the outer hook portions 1270 on the outside of the pair of notches 1244, 1244. In one implementation, the outer hook portions 1270 may additionally carry a wall 852 as was described for the corner board locator 828, or a wall 1052 as was described for the corner board locator 1028.

Method

Specific methods of using the corner board protector 20 to protect one of more corners 32 on either a palletized stack 21 of containers 22 or a single article 722 positioned on a pallet 24 will now be disclosed. Starting with a palletized stack 21 of containers 22, a method includes forming a one piece, corner board locator 28 having a connection portion 36 and an insert portion 38. The corner board locator 28 also has an opening or slot 44 formed therethrough. The insert portion 38 is positioned between two vertically aligned consecutive containers 22, 22 of the palletized stack 21 of containers 22. Alternatively, the insert portion 38 could be positioned between the pallet 24 and the lower most container 22 located directly above the pallet 24. The method also includes forming a corner board 26 having two angled panels and a length. The two angled panels of the corner board 26 are then inserted through the opening or slot 44 formed in the corner board locator 28 to retain the corner board 26 at a select height relative to the palletized stack 21 of containers 22. Desirably, the opening or slot 44 includes a right angled slot 44 and the corner board 26 is configured with two right angled panels which when inserted into the right angled slot 44 will create a friction fit therewith.

The corner board 26 is designed and sized to slide vertically within the opening or slot 44 formed through the corner board locator 28. It should be understood that one, two, three, four, five, or more corner board locators 28 can be used with each corner board 26. The number of corner board locators 28 used will partly depend on the overall height of the palletized stack 21, the number and physical size or dimension of each container 22 in the palletized stack 21, and the weight of each container 22. Desirably, one, two, three, four or five corner board locators 28 can be use with each corner board 26. More desirably, one two or three corner board locators 28 can be use with each corner board 26. The corner board locators 28, 28 should be spaced apart from one another. This spacing can vary depending on the physical size of each container 22, the number of containers 22, and the location of each seam, interface or crack 48 between adjacent containers 22 or between the pallet 24 and the lower most container 22.

It should be recognized that all of the containers 22 making up the stack 21 do not have to be of the same physical dimensions. Therefore, the location of the various seams, interfaces or cracks 48 can vary. If the palletized stack 21 of containers 22 has a square or rectangular cross-section, it will have four corners 32. Each of the four corners 32 should be protected by a corner board 26 and one or more corner board locators 28. If the palletized stack 21 of containers 22 had a triangular cross-section, it will have three corners 32. Each of the three corners 32 should be protected by a corner board 26 and one or more corner board locators 28. If the palletized stack 21 had a polygon, hexagon or some other geometrical shape with more than four corners, then each of the corners 32 should be protected by a corner board 26 and one or more corner board locators 28.

It should be understood that the palletized stack 21 of containers 22 can be strapped to the pallet 24 is needed. Also, stretch wrap material can be used to wrap the palletized stack 21 of containers 22 after the corner boards 22 and the corner board locators 28 have been attached to the palletized stack 21 of containers 22. The first and second hooks 140, 140, which are located on opposite ends of the insert portion 38 are configured to receive and grip the stretch wrap material.

A second method of using a corner board protector 20 to protect each and every corner 32 of a palletized stack 21 of containers 22 includes the steps of forming a one piece, corner board locator 28 having a connection portion 36 and an insert portion 38. The insert portion 38 has a single continuous planar exterior edge, and the corner board locator 28 has an opening or slot 44 formed therethrough. The single continuous planar exterior edge of the insert portion 38 is positioned between two vertically aligned consecutive containers 22, 22 of the palletized stack 21 of containers 22. A corner board 26 is formed with two angled panels and a length. The two angled panels of the corner board 26 are inserted through the opening or slot 44 formed in the corner board locator 28 to retain the corner board 26 at a select height relative to the palletized stack 21 of containers 22. The method further includes positioning a stretch wrap material around the palletized stack 21 of containers 22.

It should be understood that the corner board locator 28 can have an upstanding wall 840, 940 or 1040 formed on the connection portion 36, if desired.

The insert portion 38 of the corner board locator 28 projects outward away from the two angled panels formed in the corner board 26 when the two angled panels of the corner board 26 are inserted into the opening or slot 44 formed through the corner board locator 28. The insert portion 38 of the corner board locator 28 has a thickness which is less than about 0.25 inches. This relatively, thin dimension allows the insert portion 38 to be inserted between two vertically aligned consecutive containers 22, 22 without tipping an overlying container 22. Optionally, the insert portion 38 of the corner board locator 26 can be positioned between a lower most container 22 and the pallet 24 on which the lower most container 22 is placed. Alternatively, the insert portion 38 of the corner board locator 28 can have an outwardly projecting tongue which can be inserted between two vertically aligned consecutive containers 22, 22 of the palletized stack 21 of containers 22.

A third method of using a corner board protector 20 to protect each and every corner 32 of a palletized stack 21 of containers 22 includes the steps of forming a one piece, corner board locator 28 having a connection portion 36 and an insert portion 38. The corner board locator 28 also has an opening or slot 44 formed therethrough. A corner board 26 is formed having two angled panels and a length. The two angled panels of the corner board 26 are inserted through the opening or slot 44 formed in the corner board locator 28. Both the corner board locator 28 and the corner board 26 are positioned adjacent to a corner 32 of the palletized stack 21 of containers 22. The insert portion 38 of the corner board locator 28 is inserted between two vertically aligned consecutive containers 22, 22 of the palletized stack 21 of containers 22 to retain the corner board 26 at a select height relative to the palletized stack 21 of containers 22.

It should be understood that the stack 21 of containers 22 can be positioned on a pallet 24 before the corner board locator 28 is inserted between two vertically aligned consecutive containers 22, 22. As mentioned above one two, three, four five or more corner board locators 28 can be use with each corner board 26 depending on the height of the palletized stack 21 of containers 22.

The insert portion 38 can have an antiskid surface 354, 454 or 1054 wherein the antiskid surface 354, 454 or 1054 has a greater coefficient of friction than each of the containers 22, 22 between which it is inserted. The corner board locator 28 can have a single continuous planar exterior edge with a tip 50 or 150. The corner board locator 28 also can contain first and second hooks 140, 140 formed on opposite ends the insert portion 38 which are configured to receive and grip a stretch wrap material. The stretch wrap material can be positioning around the palletized stack 21 of containers 22, the corner board 26, and the corner board locator 28.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A method of using a corner board protector to protect a corner of a palletized stack of containers, said method comprising the steps of:

a) forming a one piece, corner board locator having a connection portion and an insert portion, and said corner board locator having an opening formed therethrough;

b) positioning said insert portion between two vertically aligned consecutive containers of said palletized stack of containers;

c) forming a corner board having two angled panels and a length; and d) inserting said two angled panels through said opening formed in said corner board locator to retain said corner board at a select height relative to said palletized stack of containers.

2. The method of claim 1 further comprising using at least two corner board locators at spaced apart locations.

3. The method of claim 2 further comprising strapping said palletized stack of containers to said pallet.

4. The method of claim 1 further comprising forming first and second hooks on opposite ends of said insert portion, said first and second hooks being configured to receive and grip shrink wrap to facilitate wrapping said palletized stack of containers.

5. The method of claim 1 further comprising forming said corner board from cardboard.

6. The method of claim 1 further comprising forming said corner board from styrofoam.

7. The method of claim 1 further comprising forming said corner board from an open or closed cell polymer.

8. The method of claim 1 wherein said opening formed through said corner board locator includes a right angled slot, and wherein said two angled panels are two right angled panels which when inserted into said right angled slot creates a friction fit therewith.

9. The method of claim 8 wherein said corner board can slide vertically within said right angled slot.

10. A method of using a corner board protector to protect a corner of a palletized stack of containers, said method comprising the steps of:

a) forming a one piece, corner board locator having a connection portion and an insert portion, said insert portion having a single continuous planar exterior edge, and said corner board locator having an opening formed therethrough;

b) positioning said single continuous planar exterior edge of said insert portion between two vertically aligned consecutive containers of said palletized stack of containers;

c) forming a corner board having two angled panels and a length;

d) inserting said two angled panels through said opening formed in said corner board locator to retain said corner board at a select height relative to said palletized stack of containers; and e) positioning a stretch wrap material around said palletized stack of containers.

11. The method of claim 10 further comprising forming an upstanding wall on said connection portion of said corner board locator.

12. The method of claim 10 wherein said insert portion of said corner board locator projects outward away from said two angled panels formed in said cornier board when said two angled panels of said corner board are inserted into said opening of said corner board locator.

13. The method of claim 10 wherein said insert portion of said corner board locator has a thickness which is less than about 0.25 inches, and said insert portion can be inserted between two vertically aligned, consecutive containers without tipping an overlying container.

14. The method of claim 10 further comprising positioning said insert portion of said corner board locator between a lower most container and a pallet on which said lower most container is placed.

15. The method of claim 10 wherein said insert portion of said corner board locator has an outwardly projecting tongue which can be inserted between two vertically aligned consecutive containers of said palletized stack of containers.

16. A method of using a corner board protector to protect a corner of a palletized stack of containers, said method comprising the steps of:

a) forming a one piece, corner board locator having a connection portion and an insert portion, and said corner board locator having an opening formed therethrough;

b) forming a corner board having two angled panels and a length;

c) inserting said two angled panels of said corner board through said opening formed in said corner board locator; and d) positioning both said corner board locator and said corner board adjacent to a corner of said palletized stack of containers, and inserting said insert portion of said corner board locator between two vertically aligned, consecutive containers of said palletized stack of containers to retain said corner board at a select height relative to said palletized stack of containers.

17. The method of claim 16 further comprising positioning said stack of containers on a pallet before said corner board locator is inserted between two vertically aligned consecutive containers, and using at least two corner board locators.

18. The method of claim 17 wherein said insert portion has an antiskid surface, and said antiskid surface has a greater coefficient of friction than each of said containers between which it is inserted.

19. The method of claim 16 wherein said corner board locator has a single continuous planar exterior edge with a tip, and said corner board locator has first and second hooks formed on opposite ends thereof which are configured to receive and grip a shrink wrap material.

20. The method of claim 16 further comprising positioning a shrink wrap material around said palletized stack of containers, said corner board and said corner board locator.

* * * * *